US006150077A

United States Patent [19]

Vargas et al.

[11] Patent Number: 6,150,077

[45] **Date of Patent: *Nov. 21, 2000**

[54] PHOTOGRAPHIC ELEMENTS CONTAINING RELEASE COMPOUNDS

[75] Inventors: J. Ramon Vargas, Webster; David A. Dickinson, Brockport, both of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/060,802

[22] Filed: Apr. 15, 1998

Related U.S. Application Data

[63] Continuation-in-part of application No. 08/918,974, Aug. 27, 1997, abandoned.

[51] Int. Cl.[7] ..... G03C 1/34

[52] U.S. Cl. ..... 430/505; 430/544; 430/955; 430/957; 430/959

[58] Field of Search ..... 430/505, 544, 430/957, 955, 959

[56] References Cited

U.S. PATENT DOCUMENTS

| | | | |
|---|---|---|---|
| 3,674,478 | 7/1972 | Grasshoff et al. | 430/219 |
| 4,350,752 | 9/1982 | Reczek et al. | 430/219 |
| 4,554,243 | 11/1985 | Ono et al. | 430/543 |
| 4,684,604 | 8/1987 | Harder | 430/375 |
| 5,019,492 | 5/1991 | Buchanan et al. | 430/543 |
| 5,116,717 | 5/1992 | Matsushita et al. | 430/264 |
| 5,385,814 | 1/1995 | Uchida et al. | 430/544 |
| 5,487,968 | 1/1996 | Mizukawa et al. | 430/544 |
| 5,567,577 | 10/1996 | Welter et al. | 430/544 |
| 5,576,158 | 11/1996 | Ford et al. | 430/504 |
| 5,609,999 | 3/1997 | Aida et al. | 430/544 |
| 5,660,975 | 8/1997 | Ito et al. | 430/544 |
| 5,670,306 | 9/1997 | Poslusny et al. | 430/957 |
| 5,719,011 | 2/1998 | Wolff | 430/445 |
| 5,830,627 | 11/1998 | Nakai et al. | 430/544 |

FOREIGN PATENT DOCUMENTS

| | | |
|---|---|---|
| 0 684 512 A1 | 11/1995 | European Pat. Off. . |
| 58/001139 | 1/1983 | Japan . |

OTHER PUBLICATIONS

Getz, et al J. Org. Chem., 1993, 58, pp. 4913–8.

*Primary Examiner*—Hoa Van Le
*Attorney, Agent, or Firm*—Andrew J. Anderson

[57] ABSTRACT

Photographic elements are provided which contain a compound having the formula:

$$R^1—NH—(Q)_m—C(R^2)(R^3)—(TIME)_n\text{-}PAM$$

wherein: $R^1$ is an electron withdrawing moiety; Q is a group comprising a conjugated system; m is 0 or 1, and when m=1, —NH—Q—$C(R^2)(R^3)$— is a timing or linking group which undergoes electron migration along a conjugated system to cause a cleavage reaction; TIME is a timing or linking group; n is 0, 1, 2 or 3, preferably 0 or 1; PAM is a photographically active moiety; and $R^2$ and $R^3$ are independently hydrogen, susbtituted or unsubstituted alkyl, aryl, heteroaryl, alkenyl, or alkynyl groups, can be combined with $R^1$ to form a ring, or can combine together to form a ring, with the proviso $R^2$ and $R^3$ cannot together form a double bond with another atom and neither $R^2$ nor $R^3$ can be selected from RO—, RS—, $R_2N$—, or RSe— where R represents any substituent. Photographic elements comprising the novel blocked image-modifying compounds of the present invention provide for the opportunity to specifically control the strength and location of image modification. They are also useful when incorporated in oligomeric or other polymeric species. Further, when such compounds unblock to fonn development inhibitors, excellent control of push processing, control of fog development, and control of specific layer developability can be obtained. These three applications can be realized by controlling the release rates. To control push processing, steady release upon extended processing is desirable; for control of fog development, gradual release during keeping is desirable; and for control of specific layer developability, rapid release upon processing is desirable.

12 Claims, No Drawings

PHOTOGRAPHIC ELEMENTS CONTAINING RELEASE COMPOUNDS

CROSS-REFERENCE TO RELATED APPLICATIONS

This application is a continuation-in-part of U.S. Ser. No. 08/918,974 filed Aug. 27, 1997, now abandoned, the disclosure of which is incorporated by reference herein in its entirety.

FIELD OF THE INVENTION

This invention relates to silver halide photographic elements. In particular, it relates to photographic elements containing release compounds which provide a non-imagewise distribution of an image-modifying compoumd.

BACKGROUND

In silver halide color photographic materials, images are formed by reaction of oxidized silver halide developing agent and a dye precursor known as a coupler. In forming such images, it has become relatively common practice in the art to incorporate image-modifying compounds into either the developing solutions or the photographic materials themselves. These image-modifying compounds can impact such photographic properties as sharpness, granularity, contrast and color reproduction.

Incorporation of image-modifying compounds into developing solutions typically limits the ability of the compounds to adequately impact the photographic element since they must diffuse through multiple emulsion, filter or support layers. Direct incorporation of image-modifying compounds into photographic materials, by contrast, often leads to unacceptable image reproduction as such compounds can prematurely interact with other components of the photographic elements, or can decompose during shelf keeping.

It has, thus, become accepted to attach these image-modifying compounds to coupler moieties and to have them released in an imagewise manner during development of the photographic material. This, however, has the dual disadvantage of requiring image formation (as the coupler moiety reacts with oxidized developer) whenever the presence of an image-modifying compound is desired, and of providing only an imagewise release of the image-modifying compound.

There are known alternative means for incorporating image-modifying compounds into photographic materials. Image modifying compounds have been inactivated by blocking, for example, U.S. Pat. Nos. 4,684,604; 4,350,752; 5,019,492; 3,674,478; 5,116,717; and 5,567,577. The present invention offers advantages over these known methods. The compounds described in U.S. Pat. No. 4,684,604 require oxidation with oxidized developer to provide imagewise release of photographic reagents. A scientific study (Getz, et al., J. Org. Chem., 1993, 58, 4913-8) compared the release of phenols from the types of blocking groups employed in U.S. Pat. No. 4,350,752 and one type of the present invention. The cited blocking group of the present invention released phenols faster than the corresponding blocking group of U.S. Pat. No. 4,350,752. Thus, compounds of the present invention can provide faster release. The blocked reagents of U.S. Pat. No. 5,019,492 require a dinucleophile for unblocking. Those of U.S. Pat. No. 3,674,478 are described for release in instant integral elements at high (pH>13). The compounds of U.S. Pat. No. 5,116,717 and U.S. Pat. No. 5,567,577 unblock via nucleophilic aromatic substitution and are, thus, dependent on the concentrations of all nucleophiles in the system (and not alkaline hydrolysis alone).

By contrast, the release compounds of U.S. Pat. No. 5,567,577 can release development inhibitors in a non-imagewise manner, and as a result of exposure to nucleophiles normally present in the processing solutions. These release compounds provide excellent results when incorporated into reversal elements that are push processed. Push processing is a speed adjusting process utilized to compensate for insufficient exposure of the color records of a color reversal light sensitive material. Typically, it is accomplished by "pushing" the first of the development stages (that is, black and white) of reversal processing; that is, it is accomplished by prolonging the period of first development longer than that employed in normal processing. Often, however, push processing results in a degradation of color balance as the increase in speed of one color record does not match that of the other color records.

The release compounds of U.S. Pat. No. 5,567,577 are useful in elements that are push processed because they tend to release their development inhibitors after extended development times. Thus, they impact the characteristics of the photographic element primarily after the initial development phase. This allows one to affect color balance by slowing the development of one silver halide emulsion layer during the push phase while simultaneously allowing the other silver halide emulsion layers to continue developing without restraint.

Although some of the blocked or timed inhibitors known in the art are capable of impacting photographic properties primarily during the push phase of reversal processing, at certain levels or in certain photographic elements, they may be inadequate for completely controlling color balance. For this reason, it is desired to provide a mechanism by which control over color correction during push processing is optimized.

SUMMARY OF THE INVENTION

It is, therefore, an object of the present invention to provide photographic materials comprising novel blocked image-modifying compounds that are unblocked in a non-imagewise manner and that provide adequate control over image modification and particularly that can exhibit adequate color balancing when subjected to push processing.

In accordance with one embodiment of of the invention, photographic elements are provided which contain a compound having the formula:

$$R^1—NH—(Q)_m—C(R^2)(R^3)—(TIME)_n\text{-}PAM$$

wherein $R^1$ is an electron withdrawing moiety;

Q is a group comprising a conjugated system;

m is 0 or 1, and when m=1, —NH—Q—$C(R^2)(R^3)$— is a timing or linking group which undergoes electron migration along a conjugated system to cause a cleavage reaction;

TIME is a timing or linking group;

n is 0, 1, 2 or 3, preferably 0 or 1;

PAM is a photographically active moiety; and $R^2$ and $R^3$ are independently hydrogen, susbtituted or unsubstituted alkyl, aryl, heteroaryl, alkenyl, or alkynyl groups, can be combined with $R^1$ to form a ring, or can combine together to form a ring, with the proviso $R^2$ and $R^3$ cannot together form a double bond with another atom and neither $R^2$ nor $R^3$ can be selected from RO—, RS—, $R_2N$—, or RSe— where R represents any substituent.

The novel blocked image-modifying compounds of the present invention provide for the opportunity to specifically control the strength and location of image modification. They are also useful when incorporated in oligomeric or other polymeric species. Further, when such compounds unblock to form development inhibitors, excellent control of push processing, control of fog development, and control of specific layer developability can be obtained. These three applications can be realized by controlling the release rates. To control push processing, steady release upon extended processing is desirable; for control of fog development, gradual release during keeping is desirable; and for control of specific layer developability, rapid release upon processing is desirable.

One application of this technology is to improve the color balance of reversal films. The reagent is designed to not substantially affect development during normal processing time, but would upon extended development times (such as for push processing) reduce intralayer developability so as to match the developability of the other layers. These materials are stable when coated and at keeping pH. However, upon first developer processing they react with base to gradually release the inhibitor. At longer processing times (such as during push processing) more inhibitor is released. Data from bichrome coatings demonstrate the effects of increased inhibitor release at longer processing times (11 minutes vs. 4 minutes). Accelerated keeping studies of the coatings (1 week/120° F./50% RH) demonstrate acceptable keeping performance.

The present invention employs a combination which enables those skilled in the photographic art to specifically control the photographic properties of multiple types of photographic elements under various processing conditions. The advantages obtainable by the present invention are most clearly demonstrated in color reversal or black and white photographic elements that comprise as the release compound: a development inhibitor moiety and a blocking group from which the development inhibitor moiety is released, and a ballasting group other than a coupler moiety. In reversal elements, the combination provides that at the time of push processing, sensitivity changes resulting from extended development times can be controlled so as to optimize color balance. Such control can be with regard to different color records, or with regard to different layers (for example, fast or slow) in the same color record. Further, the reduction of maximum density that typically occurs during push processing can be minimized.

DETAILED DESCRIPTION OF THE PREFERRED EMBODIMENTS $R^1$ of compounds used in accordance with the invention represents an electron withdrawing moiety. Electron withdrawing moieties are those which display a positive Hammett sigma value as described, for example, in Advanced Organic Chemistry by F. A. Carey and R. J. Sundberg, volume A, pages 179–190; Plenum Press, New York 1984. Examples include aryl or alkyl sulfones sulfoxides and ketones; aryloxy or alkyloxy carboxylate esters; sulfonate esters; phosphate esters; arylamino or alkylamino carboxylic amides; tertiary substituted alkylamino or arylamino sulfonamides; halogen; fluorallyl; and other similar groups. In the present invention, the electron withdrawing group is preferably non-ionizable under alkaline conditions.

Q is a group comprising a conjugated system. Such system is preferably represented by the following formula:

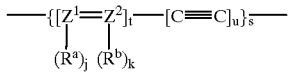

wherein $Z^1$ and $Z^2$ each independently represents a carbon or a nitrogen atom. The subscripts j and k each independently represents an integer of 0 or 1. When $Z^1$ is a carbon atom, j represents an integer of 1. When $Z^1$ is a nitrogen atom, j represents an integer of 0. When $Z^2$ is a carbon atom, k represents an integer of 1. When $Z^2$ is a nitrogen atom, k represents an inter of 0. The subscript s represents an integer of 1–5, preferably 1 or 2. The subscripts t and u each independently represents an integer of 0–5, preferably 0, 1, or 2, with at least one of t or u not being 0. $R^a$ and $R^b$ are independently hydrogen, cyano, halo, nitro, or any of the following substituted or unsubstituted substituent groups; alkyl, aryl, heteroaryl, alkenyl, alkynyl, heterocyclic, silyl, sulfonyl, acyl, alkoxycarbonyl, aryloxycarbonyl, heterocyclicoxycarbonyl, alkylthiocarbonyl, arylthiocarbonyl, heterocyclicthiocarbonyl, carbamoyl, sulfamoyl, or sulfinyl. $R^a$ and $R^b$ may combine together to form a ring, including a benzene ring or heterocyclic ring. When Q comprises an aryl or heteroaryl group, it may be further substituted, e.g., by alkoxy, aryloxy, alkylthio, arylthio, heterocyclicoxy, heterocyclicthio, acyloxy, carbamoyloxy, silyloxy, sulfonyloxy, sulfonamido, carbonamido, or ureido groups.

$R^2$ and $R^3$ are independently hydrogen, susbtituted or unsubstituted alkyl, aryl, heteroaryl, alkenyl, or alkynyl groups, can be combined with $R^1$ to form a ring, or can combine together to form a ring, with the proviso $R^2$ and $R^3$ cannot together form a double bond with another atom and neither $R^2$ nor $R^3$ can be selected from RO—, RS—, $R_2N$—, or RSe— where R represents any substituent.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4 -di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsullinyl, octylsulfinyl, 2-ethylhexylsultinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzirmidazolyloxy or 2-benzothiazolyl; quaternary ammonium, such as triethylammonium; and silyloxy, such as trimethylsilyloxy.

TIME is a timing group that, upon activation or timing, is capable of releasing the PAM. Such timing groups are well known in the art, and representative timing groups are as described, e.g., in Research Disclosure No. 36544 (1994) pg. 525 and U.S. Pat. No. 5,474,886, the disclosures of which are incorporated herein by reference.

PAM can be any group that is desirably made available in a photographic element. The PAM can be a photographic dye or a photographic reagent. A photographic reagent herein is a moiety which upon release further reacts with components in the element, such as a development inhibitor, a development accelerator, a bleach inhibitor, a bleach accelerator, a dye precursor, a dye, a developing agent (for example a competing developing agent, a dye-forming developing agent or a silver halide developing agent), a silver complexing agent, a fixing agent, an image toner, a stabilizer, a hardener, a tanning agent, a fogging agent, an ultraviolet radiation absorber, an antifoggant, a nucleator, a chemical or spectral sensitizer or a desensitizer. Such dyes and photographic reagents generally contain a hereto atom having a negative valence of 2 or 3 from Group VA or VIA of the Periodic Table, such as oxygen, sulfur, selenium and nitrogen (for example nitrogen in a heterocyclic ring). It is preferred the PAM is selected from the group consisting of development inhibitors, bleach accelerators, development accelerators, bleach inhibitors and development agent precursors.

The PAM can be present as a preformed species or it can be present in a blocked form or as a precursor. For example, a preformed development inhibitor may be attached to the timing group or the development inhibiting function may be blocked by being the point of attachment to the timing group. Representative examples of various PAMs which may be included in the compounds used in accordance with the invention include the following:

A. PAMs which form development inhibitors upon release are described in such representative patents as U.S. Pat. Nos. 3,227,554; 3,384,657; 3,615,506; 3,617,291, 3,733,201 and U.K. Patent 1,450,479. Preferred development inhibitors are iodide and heterocyclic compounds such as mercaptotetraxoles, selenotetrazoles, mercaptobenzothiazoles, selenobenzothiazoles, mercaptobenzocazoles, selenobenzoxazoles, benzotriazoles and benzodiazoles. Structures of preferred development inhibitors moieties are:

IIIA-1

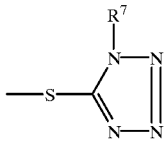

IIIA-2

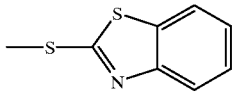

IIIA-3

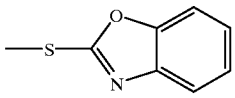

IIIA-4

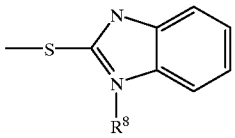

IIIA-5

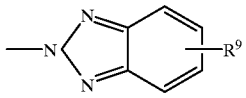

-continued

IIIA-6

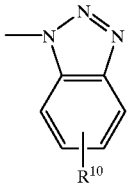

IIIA-7

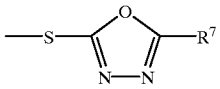

IIIA-8

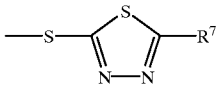

where $R^7$ and $R^8$ are individually hydrogen, alkyl of 1 to 8 carbon atoms (for example, methyl, ethyl, butyl), phenyl or substituted phenyl and $R^9$ and $R^{10}$ are individually hydrogen or one or more halogen (for example, chloro, fluoro, bromo), lower alkyl of 1 to 4 carbon atoms, carboxyl, carboxy esters (such as —$COOCH_3$), —$NHCOOCH_3$, —$SO_2OCH_3$, —$OCH_2CH_2SO_2CH_3$, —$OC(O)OCH_2CH_3$, —$NHC(O)C(O)OCH_3$ or nitro groups.

B. PAMs which are, or form, dyes upon release:

Suitable dyes and dye precursors include azo, axomethine, axopyrazolone, indoaniline, indophenyl, anthraquinone, triarylmethane, alizarin, nitro, quinoline, indigoid and phthalocyanine dyes or precursors of such dyes such as leuco dyes, tetrazolium salts or shifted dyes. These dyes can be metal complexed or metal complexable. Representative patents describing such dyes are U.S. Pat. Nos. 3,880,658; 3,931,144; 3,932,380; 3,932,381 and 3,942,987. Preferred dyes and dye precursors are azo, azomethine and indoaniline dyes and dye precursors. Structures of some preferred dyes and dye precursors are:

IIIB-1

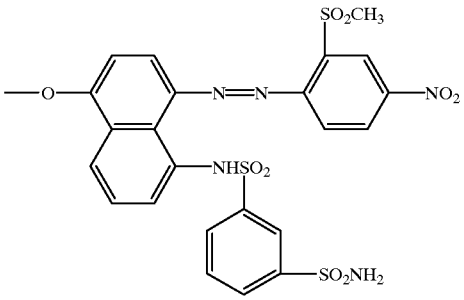

-continued

IIIB-2

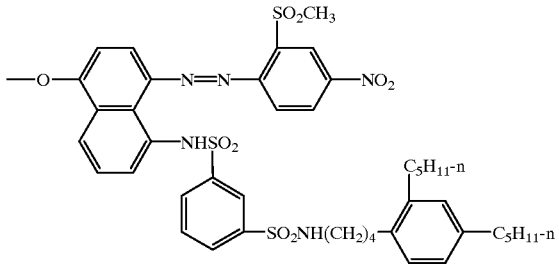

IIIB-3

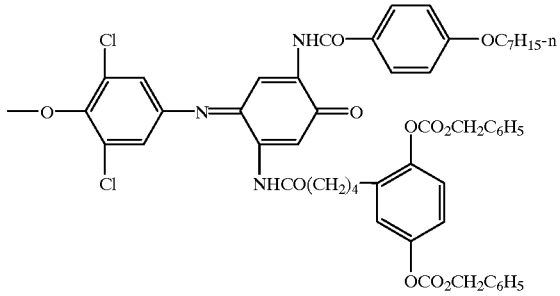

IIIB-4

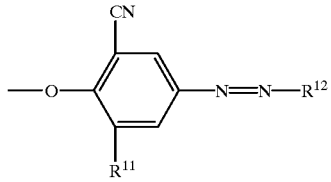

| $R^{11}$ | $R^{12}$ |
|---|---|
| —H | 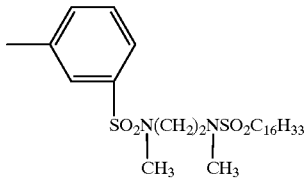 |
| —Cl | 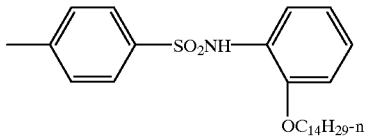 |
| —Cl | 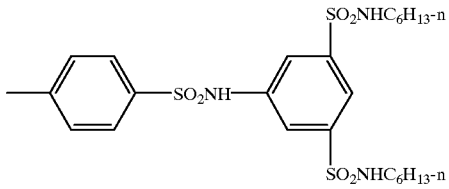 |

C. PAMs which form developing agents:

Developing agents released can be color developing agents, black-and-white developing agents or cross-oxidizing developing agents. They include aminohenols, phenylene diamines, hydroquinones and pyrazolidones.

Representative patents are: U.S. Pat. Nos. 2,193,015; 2,108,243; 2,592,364; 3,656,950; 3,658,525; 2,751,297; 2,289,367; 2,772,282; 2,743,279; 2,753,256; and 2,304,953.

Structures of preferred developing agents are:

IIIC-1

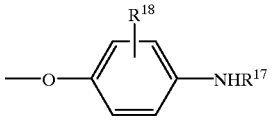

where $R^{17}$ is hydrogen or alkyl of 1 to 4 carbon atoms and $R^{18}$ is hydrogen or one or more halogen (for example, chloro, bromo) or alkyl of 1 to 4 carbon atoms (for example, methyl, ethyl, butyl) groups.

IIIC-2

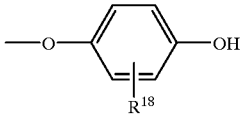

where $R^{18}$ is as defined above:

IIIC-3

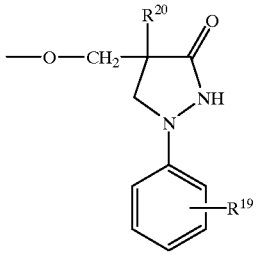

IIIC-4

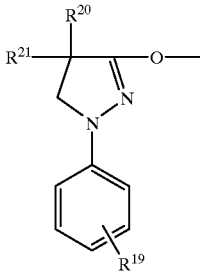

IIIC-5

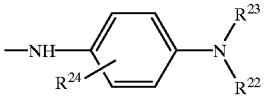

IIIC-6

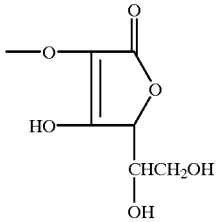

where $R^{19}$ is hydrogen or alkyl of 1 to 4 carbon atoms and $R^{20}$, $R^{21}$, $R^{22}$, $R^{23}$ and $R^{24}$ are individually hydrogen, alkyl of 1 to 4 carbon atoms (for example, methyl, ethyl) lower hydroxyalkyl of 1 to 4 carbon atoms (for example, hydroxymethyl) or lower sulfoalkyl.

D. PAMs which are bleach inhibitors:

Representative patents are U.S. Pat. Nos. 3,705,801; 3,715,208; and German OLS No. 2,405,279. Structures of preferred bleach inhibitors are:

IIID-1

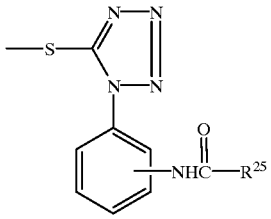

IIID-2

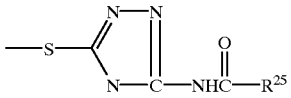

IIID-3

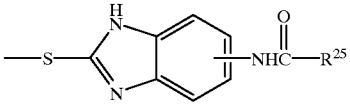

IIID-4

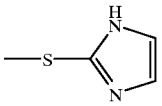

IIID-3

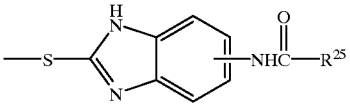

IIID-4

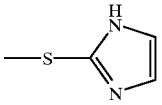

where $R^{25}$ is an alkyl group of 6 to 20 carbon atoms.

E. PAMs which are bleach accelerators:

IIIE-1

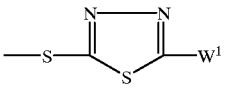

IIIE-2

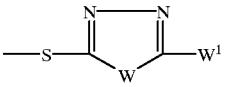

IIIE-3

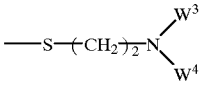

IIIE-4

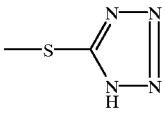

-continued

IIIE-5

—$SCH_2CH_2COOH$ wherein $W^1$ is hydrogen, alkyl, such as ethyl or butyl, alkoxy, such as ethoxy and butoxy, or alkylthio, such as ethylthio and butylthio, for example containing 1 to 6 carbon atoms, and which may be unsubstituted or substituted; $W^2$ is hydrogen, alkyl or aryl, such as phenyl; $W^3$ and $W^4$ are individually alkyl, such as alkyl containing 1 to 6 carbon atoms, for example ethyl and butyl; z is 1 to 6.

In accordance with particularly preferred embodiments, photographic elements in accordance with the invention contain a release compound that provides a non-imagewise distribution of a development inhibitor moiety. The release compound comprises a blocking group from which the development inhibitor moiety is released, and additionally preferably comprises a ballasting group other than a coupler moiety. A particularly useful embodiment is where such development inhibitor compounds are used in combination with an accelerator addenda in an adjacent layer of the photographic element as described U.S. Pat. No. 5,460,932, the disclosure of which is incorporated by reference herein.

In more preferred embodiments, $R^1$ in the compound used in accordance with the invention is represented by $R^4C(=O)$—, $R^4S(=O)_2$—, $R^4S(=O)$—, or $R^4R^5P(=O)$—, wherein $R^4$ and $R^5$ are independently substituted or unsubstituted alkyl, aryl, alkoxy, aryloxy, amino, arylthio, alkylthio, or heterocyclic groups, or $R^4$ and $R^5$ may connect to form a ring which includes the phosphorous atom. Various substitutions which can be made on the above materials include where $R^4$ (and/or $R^5$) are phenyl, nitrophenyl, methoxyphenyl, cyanophenyl, tolyl, methyl, trifluoromethyl, butyl, perfluorobutyl, cyclohexyl, 3- or 4-acetylphenyl, 3- or 4-trifluoroacetylphenyl, 3- or 4-methoxycarbonylphenyl.

Especially preferred embodiments of the invention are where $R^1$— is $R^4C(=O)$— or $R^4S(=O)_2$— when m is 0 and n is 0, and where $R^1$— is $R^4S(=O)_2$— or $R^4R^5P(=O)$— when m is 1, Q represents a p-phenylene group, and n is 0.

Representative examples of the compounds employed in the present invention are shown below in Table I.

TABLE I

RC-1

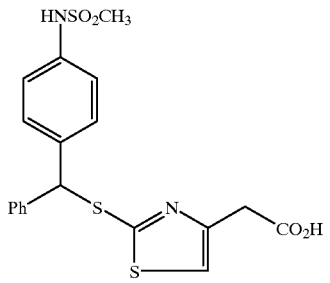

RC-2

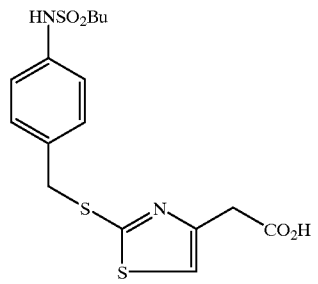

RC-3

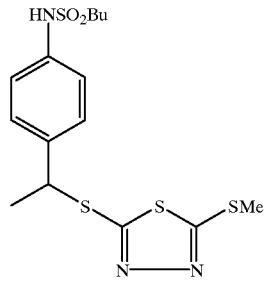

TABLE I-continued
RC-4
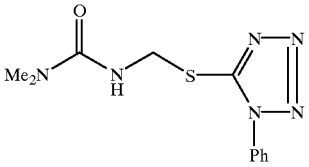
RC-5
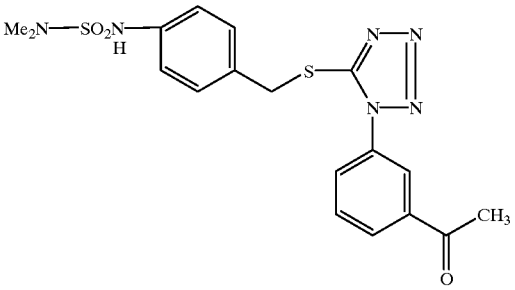
RC-6
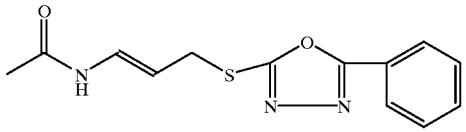
RC-7
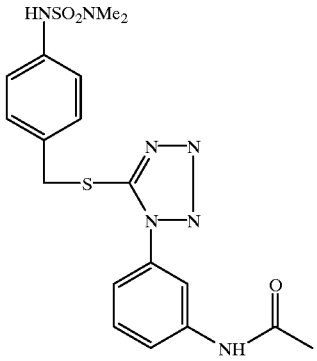
RC-8
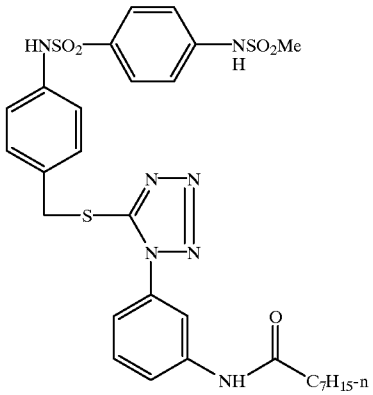

TABLE I-continued
RC-9
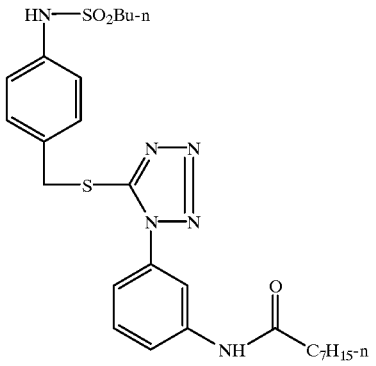
RC-10
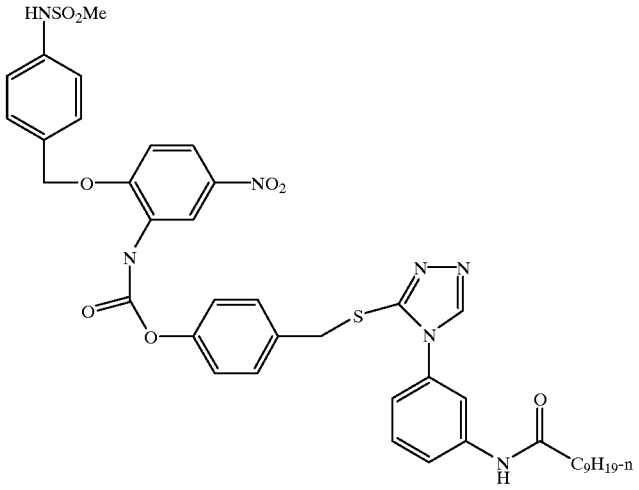
RC-11
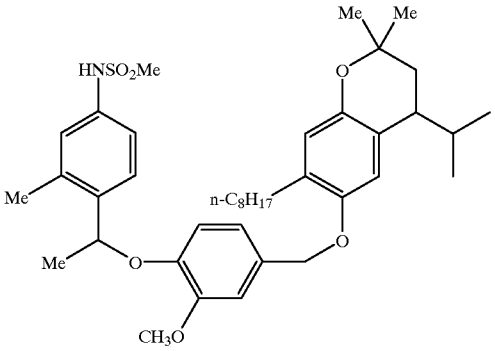
RC-12
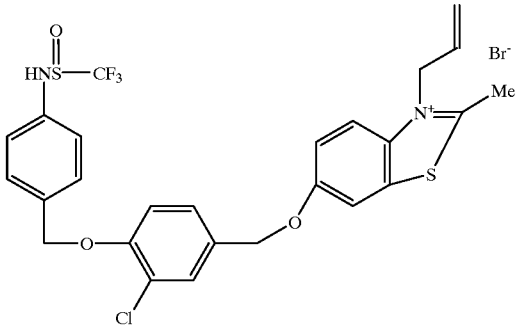

TABLE I-continued
RC-13
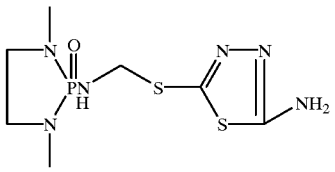
RC-14
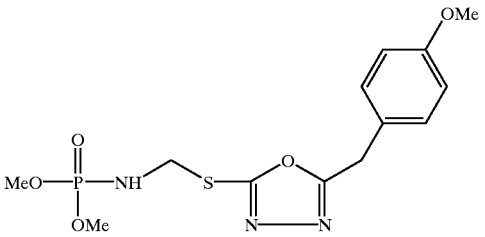
RC-15
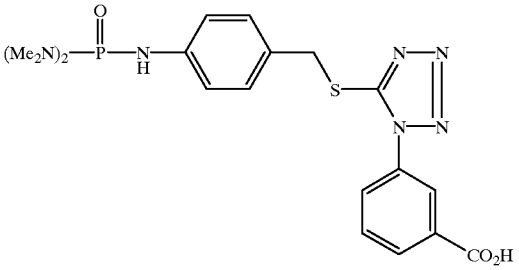
RC-16
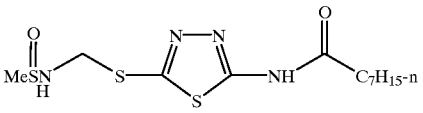
RC-17
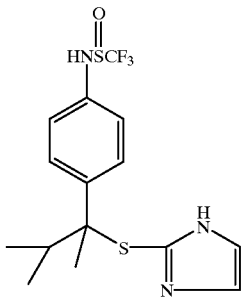
RC-18
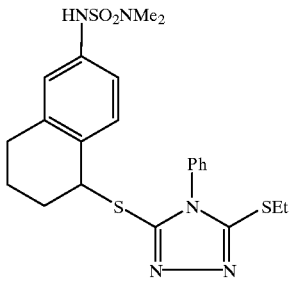

TABLE I-continued
RC-19
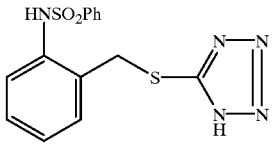
RC-20
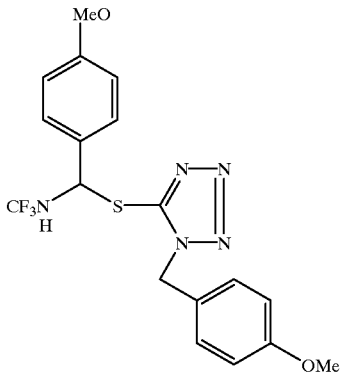
RC-21
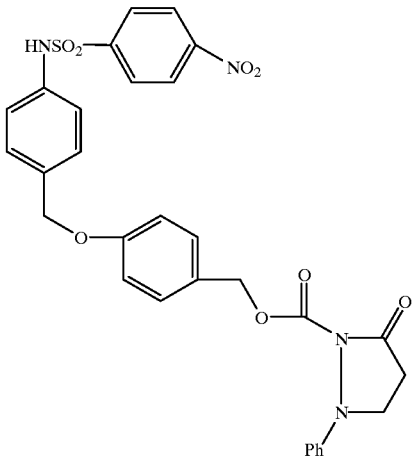
RC-22
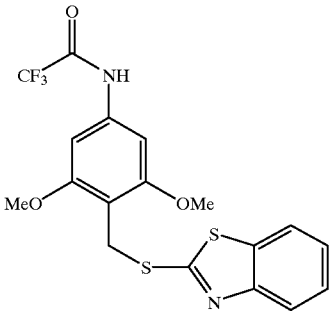
RC-23
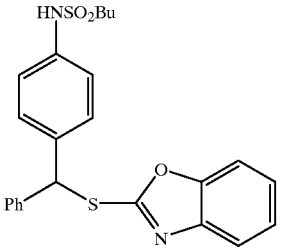

TABLE I-continued
RC-24
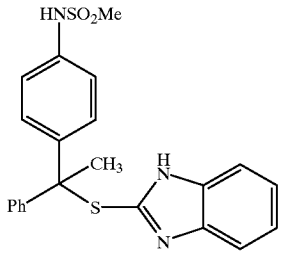
RC-25
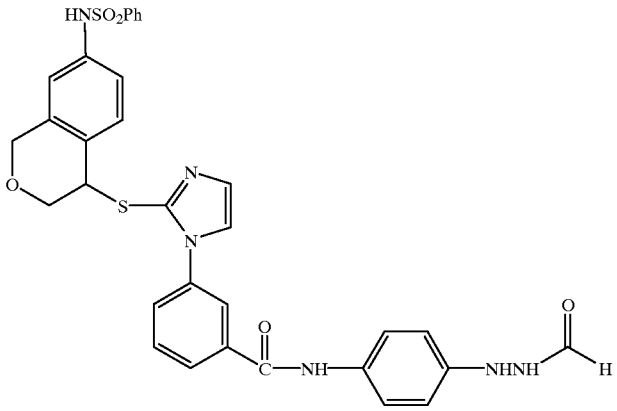
RC-26
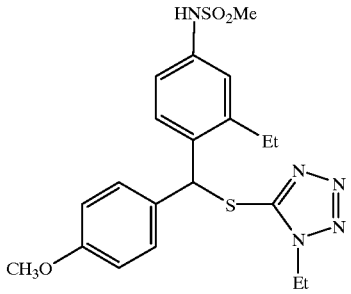
RC-27
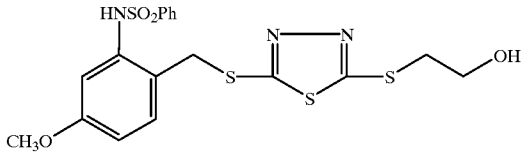
RC-28
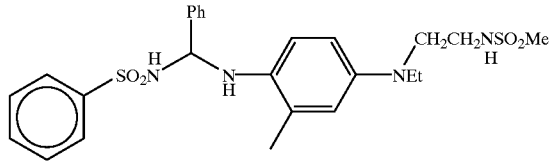

TABLE I-continued

RC-29

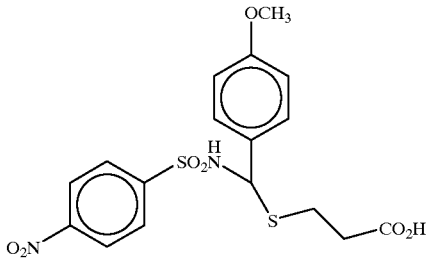

RC-30

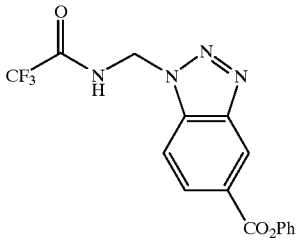

RC-31

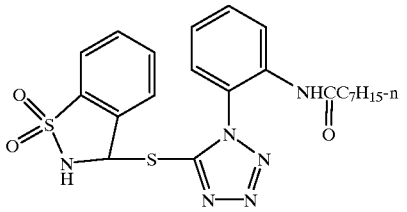

RC-32

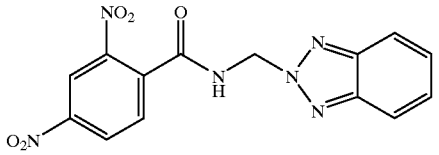

RC-33

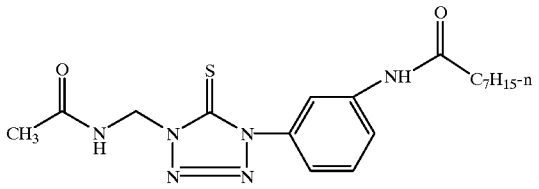

RC-34

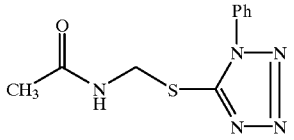

RC-35

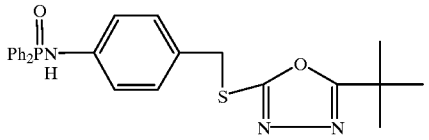

Generally, the novel compounds of this invention can be made in the following manner:

In general, all reactions were performed under a dry inert atmosphere (nitrogen or argon) and magnetically stirred unless otherwise specified. All reaction solvents employed were of reagent grade quality or better. N,N-dimepthyl aniline and triethylamine were dried over potassium hydroxide pellets. Tetrahydrofuran and dimethylformamide were dried over molecular sieves (3 or 4 angstrom). Brine refers to saturated sodium chloride solution. When solutions were concentrated, they were concentrated in vacuo. $^1$H NMR spectra were obtained at 300 MHz on a QE-300 spectrometer. All chemical shifts were measured relative to residual solvent resonances (δ $CHCl_3$=7.26, δ DMSO=2.49). Melting points were determined on a Thomas-Hoover apparatus and are uncorrected.

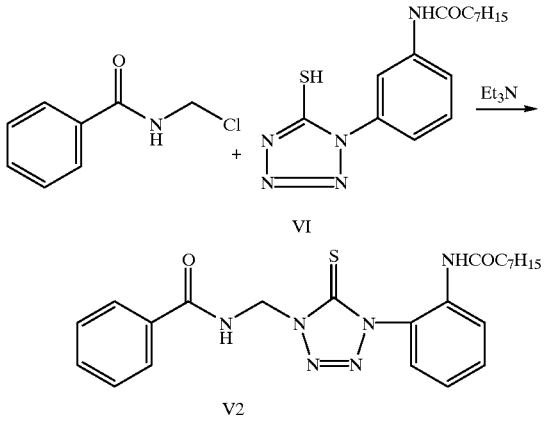

Chloromethylbenzamide

The preparation was as described by Getz, et al., J. Org. Chem., 1992, 57, 1702–6. The compound was used immediately in the next reaction. $^1$H NMR analysis ($CDCl_3$) showed a shift of the methylene doublet from 4.96 ppm to 5.42 ppm.

V2

A solution of chloromethyl benzamide (4.29 g, 25 mmol), V1 (8.05 g, 25 mmol) in tetrahydrofuran (250 mL) was treated with triethylamine (5.08 g, 7 mL, 50 mmol) held at ambient temperature for 0.75 h, then heated to reflux for 2.75 h. The reaction mixture was diluted with ethyl acetate (800 mL) and washed successively with 2 N HCl (80 mL) then brine (80 mL), dried ($MgSO_4$) and concentrated to a glass. Chromatography on silica gel (9:1 dichloromethane/ethyl acetate eluent) followed by ether trituration provided a white solid (V2), mp 149–150° C. (7.82 g, 69% yield). HPLC analysis 99.1% pure, 0.16% free inhibitor. Combustion analysis for $C_{23}H_{28}N_6O_2S$ (calcd., found) C (61.04, 60.80); H (6.24, 6.11); N (18.57, 18.35). $^1$H NMR ($CDCl_3$) δ: 8.20 (s, 1H); 7.86-7.42 (m, 4H); 7.36 (s, 1H); 6.01 (d, 2H); 2.37 (t, 2H); 1.72 (m, 2H); 1.40-1.20 (m, 8H); 0.88 (t, 3H).

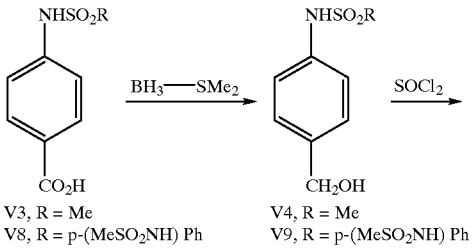

-continued

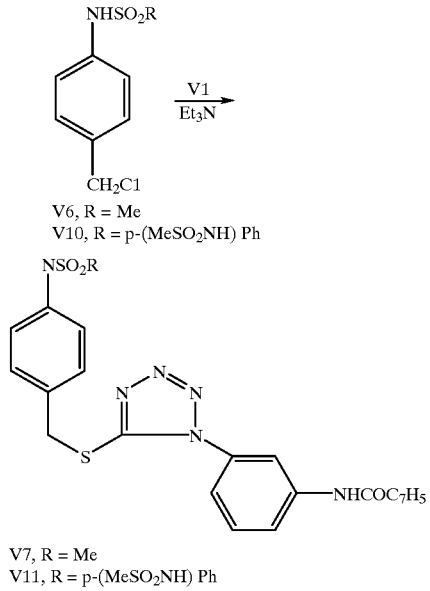

V4

A 10.0 M solution of borane-methyl sulfide (5 mL, 50 mmol) was added dropwise to an ice cooled solution of acid, V3 (5.39 g, 25 mmol) in dry tetrahydrofuran (40 mL). After stirring at ambient temperature overnight, the reaction was quenched with methanol and concentrated. The residue was dissolved in ethyl acetate, washed with pH 8.0 buffer, brine, dried ($MgSO_4$) and concentrated. A portion was recrystallized (dichloroethane) to provide a white solid (V4), mp 88–89° C. (86% yield). H NMR ($CDCl_3$) δ: 7.36 (d, 2H); 7.21 (d, 2H); 6.68 (br s, 1H); 4.68 (d, 2H); 3.00 (s, 3H); 1.80 (t, 1H).

V6

A solution of alcohol, V4 (1.01 g, 5 mmol) in 1:1 dichloromethane/tetrahydrofuran (5 ml each) was treated with thionyl chloride (0.40 mL, 654 mg, 5.5 mmol) and stirred at ambient temperature for 1.5 h. The crude product was concentrated, redissolved in dichloromethane (10 mL) and reconcentrated to afford quantitatively the chloride (V6). $^1$H NMR ($CDCl_3$) δ: 7.38 (d, 2H); 7.21 (d, 2H); 6.73 (br s, 1H); 4.57 (s, 2H); 3.03 (s, 3H).

V7

Triethylamine (1.4 mL, 1.0 g, 10 mmol) was added to a mixture of V1 (1.60 g, 5 mmol), sodium iodide (0.19 g, catalytic) and the crude benzyl chloride, V6, (5.0 mmol) in dry THF (17 mL) and the reaction was stirred at ambient temperature for 2 h. The mixture was diluted with ethyl acetate and washed with 2N HCl, brine, dried ($Na_2SO_4$) and concentrated. The crude product was chromotographed on silica gel (9:1, dichloromethane/ethyl acetate eluent) to provide a glass (1.22 g, 49% yield). HPLC analysis: 97% pure. $^1$H NMR ($CDCl_3$) δ: 7.83 (s, 1H); 7.61 (d, 1H); 7.46 (m, 2H); 7.38 (d, 2H); 7.23 (d, 1H); 7.14 (d, 2H) 6.58 (s, 1H); 4.55 (s, 2H); 3.01 (s, 3H) 2.39 (t, 2H); 1.73 (m, 2H); 1.4-1.2 (m, 8H); 0.87 (t, 3H).

V9

A 2.0 M solution of borane-methyl sulfide (17 mL, 34 mmol) was added dropwise to an ice cooled solution of acid, V8 (6.26 g, 17 mmol) in dry tetrahydrofuran (17 mL). After stirring at ambient temperature for an hour, the reaction was quenched with methanol and concentrated. The residue was dissolved in ethyl acetate, washed with 5% sodium bicarbonate solution, brine, dried ($MgSO_4$) and concentrated.

Recrystallization (ethyl acetate) provided a white solid, mp 135.5–139° C. (87% yield). $^1$H NMR (DMSO) δ: 10.34 (br s, 1H); 10.13 (br s, 1H); 7.68 (d, 2H); 7.24 (d, 2H); 7.14 (d, 2H); 7.02 (d, 2H); 5.06 (t, 1H); 4.35 (d, 2H); 3.09 (s, 3H).

V10

A solution of alcohol, V8 (1.01 g. 5 mmol) in dichloromethane/tetrahydrofuran (5 ml each) was treated with thionyl chloride (0.40 mL, 654 mg, 5.5 mmol) and stirred at ambient temperature for 1.5 h. The crude product was concentrated, redissolved in dichloromethane (10 mL) and reconcentrated to afford quantitatively the chloride as a white solid, mp 163–164° C. (97% yield). $^1$H NMR (CDC13) δ: 9.88 (br s, 1H); 9.55 (br s, 1H); 7.62 (d, 2H); 7.19 (d, 2H); 7.06 (AB q, 4H); 4.39 (s, 2H); 2.87 (s, 3H).

V11

The preparation was analogous to V7, but starting with V10, omitting sodium iodide and for a reaction time of 1 h. Chromatography on silica gel (3:1 dichloromethane/ethyl acetate eluent) gave pure product (70% yield). HPLC analysis: 99.2% pure, 0.01% free inhibitor. Combustion analysis for $C_{29}H_{35}N_7O_5S_3$ (calcd., found): C (52.95, 52.59); H (5;36, 5.30); N (14.90, 14.53). $^1$H NMR (DMSO) δ: 10.33 (br s, 2H); 10.24 (s, 1H); 7.98 (s, 1H); 7.69 (m, 3H); 7.51 (t, 1H); 7.35-7.15 (m, 5H); 7.02 (d, 2H); 4.50 (s, 2H); 3.08 (s, 3H); 2.31 (t, 2H); 1.57 (m, 2H); 1.35-1.15 (m, 8H); 0.84 (t, 3H).

Photographic elements in which the compounds of this invention are incorporated can be a simple element comprising a support and a single silver halide emulsion layer or they can be multilayer, multicolor elements. The compounds of this invention can be incorporated in at least one of the silver halide emulsion layers and/or in at least one other layer, such as an adjacent layer. The silver halide emulsion layer can contain or have associated with it, photographic coupler compounds, such as dye-forming couplers, colored masking couplers, and/or competing couplers. Additionally, the silver halide emulsion layers and other layers of the photographic element can contain addenda conventionally contained in such layers.

A typical multilayer, multicolor photographic element according to this invention can comprise a support having thereon a red-sensitive silver halide emulsion unit having associated therewith a cyan dye image providing material, a green-sensitive silver halide emulsion unit having associated therewith a magenta dye image providing material and a blue-sensitive silver halide emulsion unit having associated therewith a yellow dye image-providing material, at least one of the silver halide emulsion units having associated therewith a photographic coupler of the invention. Each silver halide emulsion unit can be composed of one or more layers and the various units and layers can be arranged in different locations with respect to one another.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the silver halide grains. They can be chemically and spectrally sensitized. The emulsions typically will be gelatin emulsions although other hydrophilic colloids are useful. Tabular grain light sensitive silver halides are particularly useful such as described in *Research Disclosure*, January 1983, Item No. 22534 and U.S. Pat. No. 4,434,226.

The support can be any support used with photographic elements. Typical supports include cellulose nitrate film, cellulose acetate film polyvinylacetal film, polyethylene terephthalate film, polycarbonate film and related films or resinous materials as well as glass, paper, metal and the like. Typically, a flexible support is employed such as a polymeric film or paper support. Paper supports can be acetylated or coated with baryta and/or an a-olefin polymer, particularly a polymer of an a-olefin polymer, particularly a polymer of an a-olefin containing 2 to 10 carbon atoms such as polyethylene, polypropylene, ethylene-butene copolymers and the like.

Suitable levels of release compounds utilized in the present invention are about 0.02 to about 25 mmole/mole silver. Preferred levels are about 0.05 to about 15 mmole/mole silver. Most preferred levels are 0.1 to 2.0 mmole/mole silver.

The release compounds employed in the present invention may be incorporated into a silver halide emulsion comprising any form (that is, cubic, octahedral, dodecahedral, spherical or tabular) of silver halide grains. It is preferred, however, that the present invention be practiced with tabular grains having an aspect ratio greater than 2:1, preferably at least 5:1, and optimally at least 7:1. Aspect ratio as used herein is understood to mean the ratio of the equivalent circular diameter of a grain to its thickness. The equivalent circular diameter of a grain is the diameter of a circle having an equal to the projected area of the grain.

The photographic elements of the present invention may be simple singler layer elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing cyan dye image-forming unit comprising at least one red-sensitive silver halide emulsion layer having associated therewith at least on cyan dye-forming coupler; a magenta image-forming until comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element may contain additional layers, such as filer layers, interlayers, overcoat layers, subbing layers, and the like.

The photographic elements may also contain a transparent magnetic recording layer such as a layer containing magnetic particles on the underside of a transparent support. Magnetic layers have been described in U.S. Pat. Nos. 4,279,945 and 4,302,523, and *Research Disclosure*, November 1992, Item No. 34390, which are incorporated herein by reference. Typically, the element will have a total thickness (excluding the support) of from about 5 to about 30 microns.

In the following discussion of suitable materials for use in the elements of this invention, reference will be made to *Research Disclosure*, December 1978, Item 17643 and *Research Disclosure*, December 1989, Item No. 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereafter by the term "*Research Disclosure*". A reference to a particular section in "*Research Disclosure*" corresponds to the appropriate section in each of the above-identified Research Disclosures. The elements of the invention can comprise emulsions and addenda described in these publications and publications referenced in these publications.

The silver halide emulsions employed in the elements of this invention can be comprised of silver bromide, silver chloride, silver iodide, silver bromochloride, silver iodochloride, silver iodobromide, silver iodobromochloride or mixtures thereof. The emulsions can include silver halide grains of any conventional shape or size. Specifically, the emulsions can include coarse, medium or fine silver halide grains. High aspect ratio tubular grain emulsions are specifically contemplated, such as those disclosed by Wilgus et al, U.S. Pat. No. 4,434,226, Daubendiek et al, U.S. Pat. No. 4,414,310, Wey, U.S. Pat. No. 4,399,215, Solberg et al, U.S. Pat. No. 4,433,048, Mignot, U.S. Pat. No. 4,386,156, Evans et al, U.S. Pat. No. 4,504,570, Maskasky, U.S. Pat. No. 4,400,463, Wey et al, U.S. Pat. No. 4,414,306, Maskasky, U.S. Pat. Nos. 4,435,501 and 4,643,966 and Daubendiek et al, U.S. Pat. Nos. 4,672 and 4,693,964, all of which are incorporated herein by reference. Also, specifically contemplated are those silver iodobromide grains with a higher molar proportion of iodide in the core of the grain than in the periphery of the grain, such as those described in British Reference No. 1,027,146; U.S. Pat. Nos. 4,379,837; 4,444,877; 4,665,012; 4,686,178; 4,565,778; 4,728,602; 4,668,614 and 4,636,461 and in the European Reference No. 264,954, all of which are incorporated herein by reference. The silver halide emulsions can be either monodisperse or polydisperse as precipitated. The grain size distribution of the emulsions can be controlled by silver halide grain separation techniques or be blending silver halide emulsions of differing grain sizes.

Dopants, such as compounds of copper, iridium, thallium, lead, bismuth, cadmium and Group VIII noble metals, can be present alone or in combination during precipitation of the silver halide emulsion. Other dopants include transition metal complexes as described in U.S. Pat. Nos. 4,981,781; 4,936,180; 4,933,272; 5,252,451 and *Research Disclosure*, Item No. 308119, Section I-D.

The emulsions can be surface-sensitive emulsions, that is, emulsions that form latent images primarily on the surface of the silver halide grains; or internal latent image-forming emulsions, that is, emulsions that form latent images predominantly in the interior of the silver halide grains. The emulsions can be negative-working emulsions such as surface-sensitive emulsions or unfogged internal latent image-forming emulsions, but can also be direct-positive emulsions of the unfogged, internal latent image-forming type, which are positive-working when development is conducted with uniform light exposure or in the present of a nucleating agent. Preferably, the elements are reversal-working elements.

The silver halide emulsions can further be surface-sensitized, and noble metal (for example, gold), middle chalcogen (for example, sulfur, selenium, or tellurium) and reduction sensitizers, employed individually or in combination are specifically contemplated. Typical chemical sensitizers are listed in *Research Disclosure*, Item 308119, cited above, Section III.

The silver halide emulsions can be spectrally sensitized with dyes from a variety of classes, including the polymethine dye class, which includes the cyanines, merocyanines, complex cyanines and merocyanines (that is, tri-tetra-, and polynuclear cyanines and merocyanines), oxonols, hemioxonols, stryryls, merostryryls, and streptocyanines. Illustrative spectral sensitizing dyes are disclosed in *Research Disclosure*, Item 308119, Section IV.

Suitable vehicles for the emulsion layer and other layers of elements of this invention are described in *Research Disclosure*, Item 308119, Section IX and the publications cited therein.

The elements of this invention can include couplers described in *Research Disclosure*, Section VII, paragraphs D, E, F, and G and the publications cited therein. The couplers can be incorporated as described in *Research Disclosure*, Section VII, paragraph C, and the publications cited therein. Also contemplated are element which further include modifying couplers as described in *Research Disclosure*, Item 308119, Section VII, paragraph F.

The photographic elements of this invention can contain brighteners (*Research Disclosure*, Section V), antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), and those described in *Research Disclosure*, Section VI, antistain agents and image dye stabilizers (*Research Disclosure*, Section VII, paragraphs I and J), light absorbing and scattering materials (*Research Disclosure*, Section VIII), hardeners (*Research Disclosure*, Section X), polyalkyteneoxide and other surfactants as described in U.S. Pat. No. 5,236,817, coating aids (*Research Disclosure*, Section XI), plasticizers and lubricants (*Research Disclosure*, Section XII), antistatic agents (*Research Disclosure*, Section XIII), matting agents (*Research Disclosure*, Sections XII and XVI) and development modifiers (*Research Disclosure*, Section XXI).

The photographic elements can be coated on a variety of supports as described in *Research Disclosure*, Section XVII and the references described therein.

The photographic elements of the invention can be exposed to actinic radiation, typically in the visible region of the spectrum, to form a latent image as described in *Research Disclosure*, Section XVIII, and then processed to form a visible dye image as described in *Research Disclosure*, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-(β-methanesulfonamidoethyl)-aniline sulfate, 4-amino-3-methyl-N-ethyl-N-(β-hydroxyethyl)-aniline sulfate, 4-amino-3-(β-methanesulfonamidoethyl)-N,N-diethylaniline hydrochloride, and 4-amino-N-ethyl-N-(β-methoxyethyl)-m-toluidine di-p-toluenesulfonic acid. With negative-working silver halide emulsions, the processing step described above provides a negative image. The described elements can be processed in the known C-41 color process as described in, for example, the British Journal of Photography Annual, 1988, pages 196–198. To provide a positive (or reversal) image, the color development step can be preceded by development with a non-chromogenic developing agent to develop exposed silver halide, but not form dye, and then uniformly fogging the element to render unexposed silver halide developable. Reversal processing of the element of the invention is preferably done in accordance with the know K-14 process, or the known E-6 process as described and referenced in

*Research Disclosure* paragraph XIX. Alternatively, a direct positive emulsion can be employed to obtain a positive image.

Development is followed by the conventional steps of bleaching, fixing or bleach-fixing, to remove silver or silver halide, washing, and drying.

The following examples illustrate the invention using the compounds described above. The synthetic scheme described earlier is representative and can be varied by those skilled in the art to obtain other useful release compounds of this invention. Table II shows the release compounds used in the examples.

TABLE II

| Compound No. | Structure of Example Compound | Compound |
|---|---|---|
| 1 | 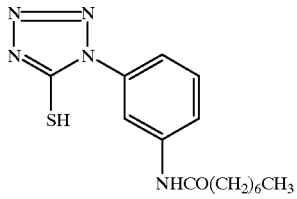 | VI |
| 2 | 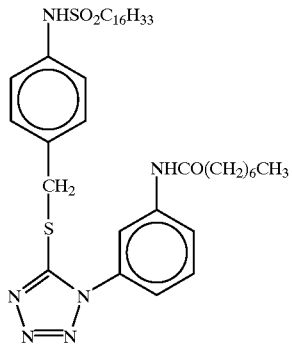 | |
| 3 | 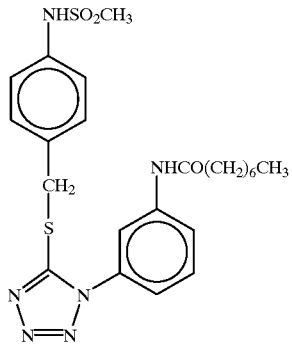 | V7 |
| 4 | 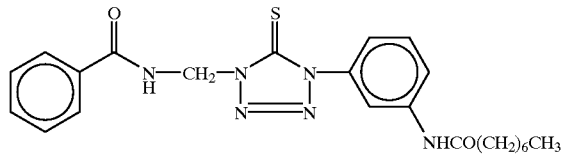 | V2 |

TABLE II-continued

| Structure of Example Compound | |
|---|---|
| Compound No. | Compound |
| V11 | 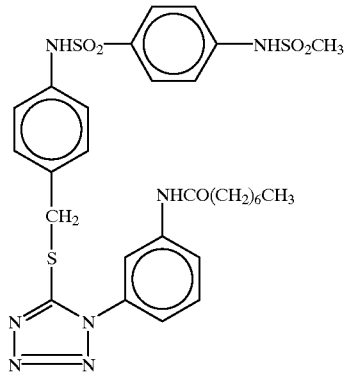 |

EXAMPLE 1

On a cellulose triacetate film support containing a subbing layer was coated each layer having the composition set forth below to prepare a multilayer color photographic light sensitive material which was designated sample 101. Components utilized are shown as g/m$^2$ except for sensitizing dyes and the comparison compounds which are shown in molar amounts/mole of silver halide present in the same layer.

| Photographic Element 101 | | |
|---|---|---|
| First Layer: | Antihalation Layer | |
| | Black Colloidal Silver | 0.43 (as silver) |
| | Gelatin | 2.44 |
| Second Layer: | Intermediate Layer | |
| | Gelatin | 1.22 |
| Third Layer: | Red Sensitive Layer | |
| | Silver Iodobromide Emulsion | 0.97 (as silver) |
| | RSD-1/RSD-2 | 0.00075 |
| | Cyan Coupler C-1 | 1.61 |
| | Dibutyl phthalate | 0.81 |
| | Gelatin | 2.37 |
| Fourth Layer: | Intermediate Layer | |
| | Competitor CP-1 | 0.21 |
| | Gelatin | 0.43 |
| Fifth Layer: | Green Sensitive Layer | |
| | Silver iodobromide emulsion | 1.10 (as silver) |
| | Sensitizing dye GSD-1 | 0.00075 |
| | Sensitizing dye GSD-2 | 0.0025 |
| | Magenta coupler M-1 | 0.46 |
| | Magenta coupler M-2 | 1.08 |
| | Tritoyl phosphate | 0.76 |
| | Gelatin | 2.37 |
| Sixth Layer: | Protective Layer | |
| | Gelatin | 2.37 |
| | Bis(vinylsulfonylmethane) | 0.19 |

Samples 102 to 103 were prepared in the same manner as described above for Sample 101 except for the addition of inhibitor addenda shown in Table II to the Green Sensitive Fifth Layer. The free inhibitor Compound No. 1 and the block invention Compound No. 2 were coated at a level of 1.2 mmole/silver mole.

Each of the samples thus prepared was cut into a 35 mm width strip. The samples were exposed to a step exposure using white light. The samples were then processed in a reversal process using standard Kodak E-6 processing solutions (note in a reversal process development inhibition occurring in the first developer will lead to speed loss and an increase of Dmax). Relative speed at two different speed points and Dmax was determined for both the green and red sensitive layer. Table III illustrates green sensitive layer response at 4', 6', 8' and 11' first developer time.

TABLE III

Comparison Between Free and Blocked Inhibitor

| Sample | First Developer Time | Inhibitor | Relative Speed 1[a] | Relative Speed 2[b] | Dmax |
|---|---|---|---|---|---|
| 101 | 4 | Control | 0.88 | 1.16 | 3.90 |
| 102 | 4 | Cmpd. No. 1 | 0.22 | 0.66 | 3.42 |
| 103 | 4 | Cmpd. No. 2 | 0.90 | 1.16 | 3.91 |
| 101 | 6 | Control | 1.19 | 1.38 | 3.67 |
| 102 | 6 | Cmpd. No. 1 | 0.71 | 1.09 | 3.10 |
| 103 | 6 | Cmpd. No. 2 | 1.16 | 1.34 | 3.66 |
| 101 | 8 | Control | 1.38 | 1.54 | 3.55 |
| 102 | 8 | Cmpd. No. 1 | 1.26 | 1.45 | 3.04 |
| 103 | 8 | Cmpd. No. 2 | 1.35 | 1.50 | 3.54 |
| 101 | 11 | Control | 1.66 | 1.79 | 3.03 |
| 102 | 11 | Cmpd. No. 1 | 1.30 | 1.65 | 2.17 |
| 103 | 11 | Cmpd. No. 2 | 1.57 | 1.71 | 3.27 |

[a]Photographic speed in log E units at a green density of 0.5
[b]Photographic speed in log E units at a green density of 1.0

The unblocked material, Compound 1, is not released as a function of development time. The unblocked material is completely available at the short 4' development time leading to large toe speed loss compared to the no inhibitor control. This differs dramatically with the blocked material Compound 2, which contains the same inhibitor fragment as Compound 1. The inhibitor from Compound 2 is slowly released to the layer as a function of time in the first developer. At the short 4' development time not enough of the inhibitor is available to impact sensitometry so Compound 2 responds similarly to the no inhibitor control. As development time increases more inhibitor is released so that at 11' development time considerable restraint is seen from Compound 2 compared to the no inhibitor control. Push control without early development penalty is demonstrated by Compound 2.

EXAMPLE 2

Sample 201 was prepared in a manner as described above for Sample 101. Samples 202 to 207 were prepared in the same manner similar to Sample 101 except for the addition of block inhibitor addenda shown in Table II to the Green Sensitive Fifth Layer. The added block inhibitor addenda added to the silver containing layer at an level of 0.6 and/or 1.2 mmole/silver mole.

Each of the samples thus prepared was cut into a 35 mm width strip. The samples were exposed to a step exposure using white light. The samples were then processed in a reversal process using standard Kodak E-6 processing solutions at two development times in the first developer. Relative speed at two different speed points and Dmax was determined for the green sensitive layer. The speed difference between four minutes and eleven minutes in the first developer is shown in Table IV, as delta speeds, along with relative speed 2 and Dmax at the four minute development time.

TABLE IV

Example 2 Green Sensitive Layer Response

| Sample | Addenda | mmol/AgM | delta 05[a] | delta 1.0[b] | Delta Dmax[c] | Relative speed 2[d] | Dmax[e] |
|---|---|---|---|---|---|---|---|
| 201 | none | 0.0 | 0.75 | 0.62 | −0.883 | 1.19 | 3.731 |
| 202 | Cmpd. No. 2 | 0.6 | 0.72 | 0.60 | −0.912 | 1.20 | 3.760 |
| 203 | Cmpd. No. 3 | 0.6 | 0.66 | 0.55 | −0.721 | 1.19 | 3.671 |
| 204 | Cmpd. No. 4 | 0.6 | 0.62 | 0.49 | −0.700 | 1.23 | 3.778 |
| 205 | Cmpd No. 4 | 1.2 | 0.63 | 0.48 | −0.643 | 1.25 | 3.707 |
| 206 | Cmpd No. 5 | 0.6 | 0.64 | 0.52 | −0.804 | 1.20 | 3.714 |
| 207 | Cmpd. No. 5 | 1.2 | 0.57 | 0.47 | −0.788 | 1.19 | 3.729 |

[a]Delta Photographic speed in log E units at a green density of 0.5
[b]Delta Photographic speed in log E units at a green density of 1.0
[c]Delta Dmax in density units
[d]Photographic speed in log E units at a green density of 1.0 at the 4 minute development condition.
[e]Photographic Dmax in density units at the 4 minute development condition.

All of the blocked inhibitors release the same inhibitor. The free inhibitor was shown in example 1 to cause significant inhibition at the short four minute development time causing speed loss and Dmax increase. None of the samples 202–207 show this inhibition effect at the short development time due to the presence of the blocking group. Release of the inhibitor fragment occurs as a function of time in the first developer. Inhibition of development at the longer development time as seen by a reduction in delta speed and delta Dmax. The invention Sample 202–207 all provide a reduction in development at the longer development time without a sacrifice in speed or an increase Dmax at the short development time. Compound 4 and compound 5 show increase effect with increased level. Structure variations control the rate of release, as can be seen comparing compound 2 to compounds 3–5.

High temperature incubation was used to demonstrate the robustness of the new technology. Invention compounds 2–5 are compared to a no addenda control The same sample discussed above were incubated for 1 week/120° F./50%RH and the results were compared to the control at 1 week/0° F./50%RH. Delta of check minus incubated sample are shown in Table V.

TABLE V

Example 2 Incubation Response of the Green Sensitive Layer

| Sample | Addenda | mmol/AgM | delta 0.5[a] | delta 1.0[b] | Delta Dmax[c] |
|---|---|---|---|---|---|
| 201 | none | 0.0 | −0.06 | −0.04 | 0.013 |
| 202 | Cmpd. No. 2 | 0.6 | −0.05 | −0.04 | 0.016 |
| 203 | Cmpd. No. 3 | 0.6 | −0.05 | −0.03 | 0.013 |
| 204 | Cmpd. No. 4 | 0.6 | −0.11 | −0.08 | 0.009 |
| 205 | Cmpd. No. 4 | 1.2 | −0.11 | −0.09 | −0.012 |
| 206 | Cmpd. No. 5 | 0.6 | −0.05 | −0.04 | −0.064 |
| 207 | Cmpd. No. 5 | 1.2 | −0.05 | −0.03 | −0.040 |

[a]Delta Photographic speed in log E units at a green density of 0.5 before and after incubation.
[b]Delta Photographic speed in log E units at a green density of 1.0 before and after incubation
[c]Delta Dmax in density units before and after incubation.

Compounds 2, 3 and 5 all behaved similar to the control on incubation, while they exhibit varied development activity show in Table IV. Speed change on incubation for compound 4, samples 204 and 205 were a little larger than the control, but did not increase as a function of level. The development control at an eleven minute development time, discussed in Table IV was seen for compounds 2–5 follow incubation.

Layer specific performance of invention sample at the 1.2 mmol/AgM level is illustrated in Table VI for the most active samples shown in Table IV. The invention samples are incorporated into the Green Sensitive Fifth Layer, photographic response shown in Table VI is from the Red Sensitive Third Layer. Only modest development inhibition is seen in the Red Sensitive layer demonstrating layer specific behavior of the invention compounds. Delta speed and Dmax compares parameters at 4 minute and 11 minute time in the first developer as discussed above.

TABLE VI

Example 2 Red Sensitive Layer Response

| Sample | Addenda | mmol/AgM | delta 0.5[a] | delta 1.0[b] | Delta Dmax[c] | Relative Speed 2[d] | Dmax[e] |
|---|---|---|---|---|---|---|---|
| 201 | none | 0.0 | 98 | 82 | −1.347 | 1.27 | 2.883 |
| 205 | Cmpd. No. 4 | 1.2 | 96 | 75 | −1.279 | 1.26 | 2.956 |
| 207 | Cmpd. No. 5 | 1.2 | 95 | 77 | −1.278 | 1.28 | 2.917 |

[a]Delta Photographic speed in log E units at a red density of 0.5
[b]Delta Photographic speed in log E units at a red density of 1.0
[c]Delta Dmax in density units
[d]Photographic speed in log E units at a red density of 1.0 at the 4 minute development condition
[e]Photographic Dmax in density units at the 4 minute development condition.

Structures used in Examples 1 and 2:

GSD-1
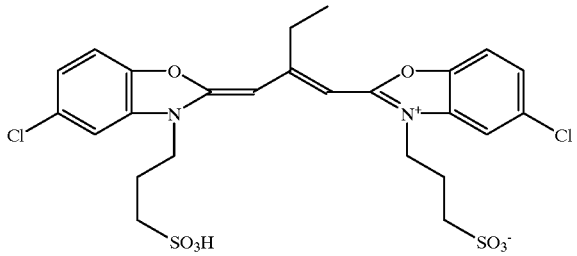
GSD-2
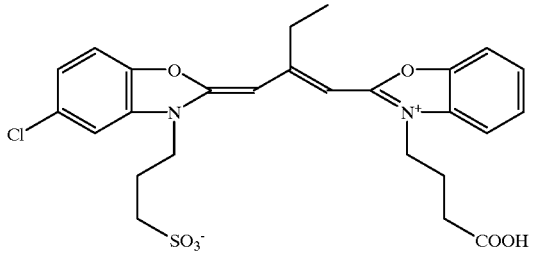
RSD-1
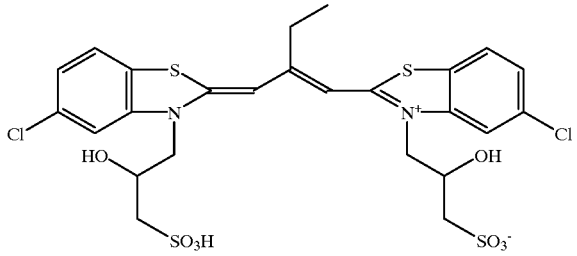
RSD-2
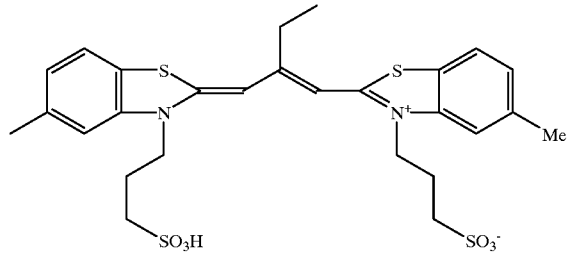
M-1
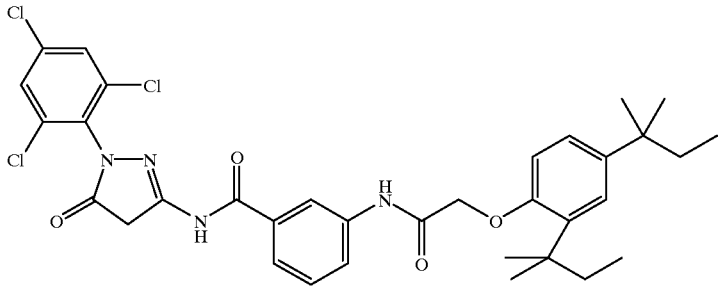

-continued

M-2

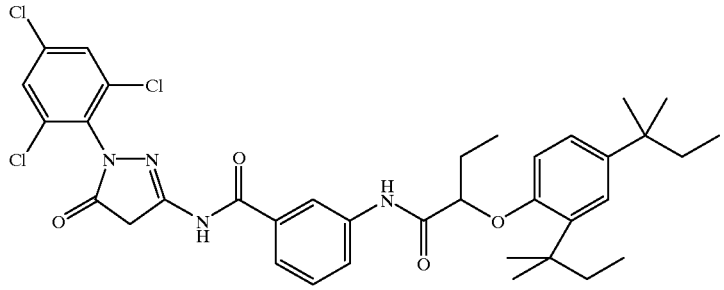

C-1

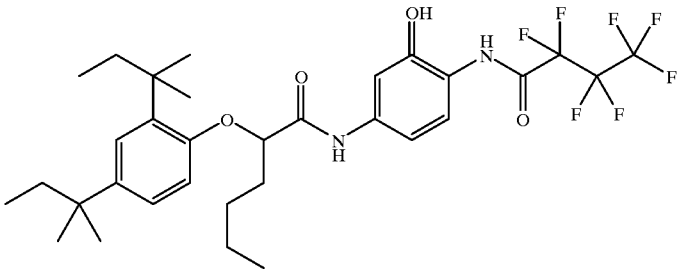

CP-1

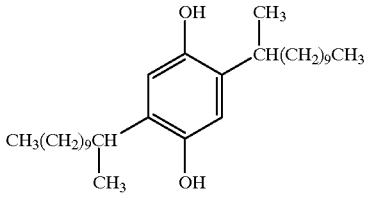

EXAMPLE 3

For a reversal format, the blocked PAMs may be coated with appropriately sensitsitized silver iodobromide emulsion in a multilayer reversal film that can be prepared as follows. Each layer having the composition set forth below is coated on a cellulose triacetate support provided with a subbing layer to prepare a multilayer color photographic light-sensitive material. In the composition of the layers, the coating amounts are shown as grams per square meter except for sensitizing dyes, which are shown as the molar amount per mole of silver halide present in the same layer. Laydowns of silver halide are reported relative to silver. Emulsion sizes as determined by the disc centrifuge method are reported in diameter x thickness in microns.

First layer: Antihalation Layer

Black Colloidal Silver 0.43
Gelatin 2.44

Second layer: Intermediate Layer

Gelatin 1.22

Third layer: Slow Red Sensitive Layer

AgIBr tabular emulsion (4% I, 0.6 × 0.1) 0.62
RSD-1/RSD-2 0.00142
C-1 0.20
Dibutyl phthalate 0.10
ST- 10.06
Gelatin 0.86

-continued

Fourth Layer: Fast Red Sensitive Layer

AgIBr tabular emulsion (4% I, 0.97 × 0.13) 0.65
RSD-1/RSD-2 0.00105
C-1 1.00
Dibutyl phthalate 0.50
Gelatin 1.83

Fifth Layer: Intermediate Layer

DYE-1 0.07
ST-1 0.12
Gelatin 1.22

Sixth Layer: Slow Green Sensitive Layer

AgIBr emulsion (3.3% I, 0.15 cubic + 4% I, 0.7 × 0.1 tabular)
0.70
GSD-1/GSD-1
0.002
M-1
0.07
M-2
0.15
Tritoyl phosphate
0.11
Gelatin
0.83

Seventh Layer: Fast Green Sensitive Layer

AgIBr tabular emulsion (4% I, 0.97 × 0.13)
0.50
GSD-1/GSD-2
0.001
M-1

-continued 0.32
M-2
0.74
Tritoyl phosphate
0.52
Gelatin
1.67

Eighth Layer: Interlayer Layer

Gelatin
2.15

Ninth Layer: Yellow Filter Layer

Carey Lea Silver
0.002
DYE-2
0.17
ST-1
0.08
Gelatin
0.61

Tenth Layer: Slow Blue Sensitive Layer

AgIBr tabular emulsion (3% I, 1.1 × 0.12)
0.28
BSD-1
0.00108
Y-1
0.66
Dibutyl phthalate
0.22
Gelatin
1.00

Eleventh Layer: Fast Blue Sensitive Layer

AgIBr tabular emulsion (3% I, 1.7 × 0.1)

-continued 0.78
BSD-1
0.0016
Y-1
1.68
Dibutyl phthatate
0.56
Gelatin
2.47

Twelfth Layer: First Protective Layer

UV-1
0.06
UV-2
0.32
UV-3
0.09
ST-1
0.06
Gelatin
1.40

Thirteenth Layer: Second Protective Layer

Fine grain AgBr emulsion
0.12
Matte
0.02
Bis(vinylsulfonylmethane)
0.26
Gelatin
0.97

Structures used in Example 3

BSD-1

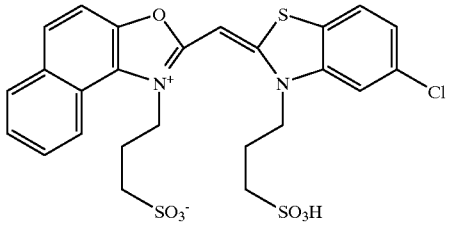

UV-1

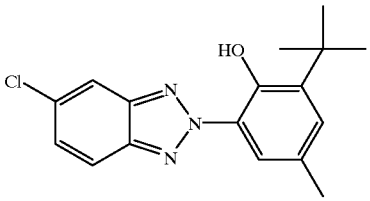

UV-2

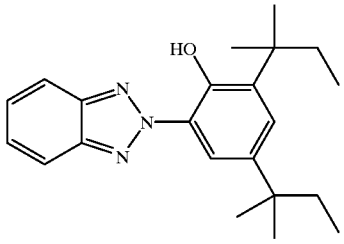

-continued

UV-3

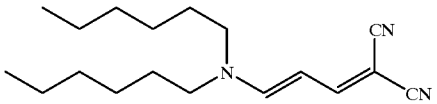

DYE-1

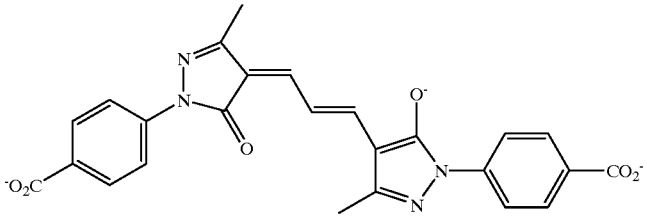

DYE-2

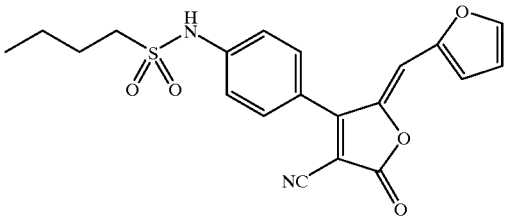

Y-1

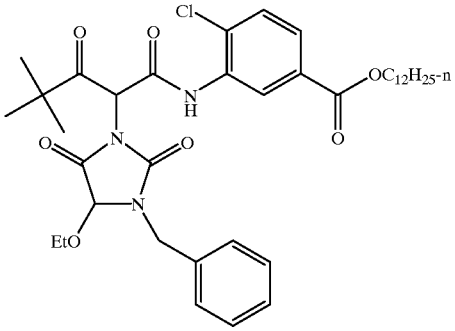

ST-1

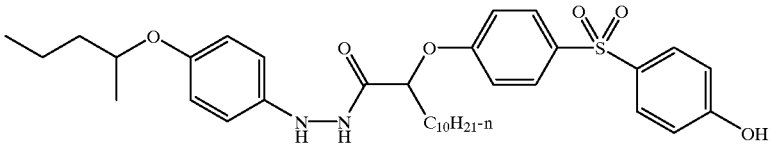

EXAMPLE 4

For a reversal format, the blocked PAMs may be coated with appropriately sensitized silver iodobromide emulsions on a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl)amino) carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]aamino]-,dodecylester; and a slow yellow layer also containing Coupler 2;

(4) an interlayer;

(5) a layer of fine-grained silver;

(6) an interlayer;

(7) a triple-coated magenta pack with a fast and mid magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-; and "Coupler 5": Benzamide, 3-(((2,4-bis(1,1-dimethylpropyl) phenoxy)-acetyl)amino)-N-(4,5-dihydro-5 -oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl)amino)-3-hydroxyphenyl)-; a mid cyan containing "Coupler 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)-phenoxy)-N-(4-((2,2,3,3,4,4,4-heptafluoro-1-oxobutyl)amino)-3-hydroxyphenyl)-; and a slow cyan layer containing Couplers 6, 7, and 8;

(10) one or more interlayers possibly including fine-grained nonsensitized silver halide; and

(11) an antihalation layer.

EXAMPLE 5:

In a negative format, the blocked PAMs may be coated with appropriatedly sensitsitized silver iodobromide emulsion in a multilayer photographic negative element that is produced by coating the following layers on a cellulose triacetate film support (coverage are in grams per meter squared, emulsion sizes as determined by the disc centrifuge method and are reported in Diameter×Thickness in microns).

Layer 1 (Antihalation layer): black colloidal silver sol at 0.151; gelatin at 2.44; UV-1 at 0.075; UV-2 at 0.075; DYE-3 at 0.042; DYE-4 at 0.088; DYE-5 at 0.020; DYE-6 at 0.008 and STAB-1 at 0.161.

Layer 2 (Slow cyan layer): a blend of two silver iodobromide emulsions sensitized with a 1/9 mixture of RSD-3/RSD-4: (i) a small tabular emulsion (1.1×0.09, 4.1 mol % I) at 0.430 and (ii) a very small tabular grain emulsion (0.5×0.08, 1.3 mol % I) at 0.492; gelatin at 1.78; cyan dye-forming coupler C-2 at 0.538; bleach accelerator releasing coupler BARC-1 at 0.038; masking coupler MC-1 at 0.027.

Layer 3 (Mid cyan layer): a red sensitized (same as above) silver iodobromide emulsion (1.3×0.12, 4.1 mol % I) at 0.699; gelatin at 1.79; C-2 at 0.204; D-1 at 0.010; MC-1 at 0.022.

Layer 4 (Fast cyan layer): a red-sensitized (same as above) tabular silver iodobromide emulsion (2.9×0.13, 4.1 mol % I) at 1.076; C-2 at 0.072; D-1 at 0.019; D-2 at 0.048; MC-1 at 0.032; gelatin at 1.42.

Layer 5 (Interlayer): gelatin at 1.29.

Layer 6 (Slow magenta layer): a blend of two silver iodobromide emulsions sensitized with a 6/1 mixture of GSD-3/GSD-4: (i) 1.0×0.09, 4.1 mol % iodide at 0.308 and (ii) 0.5×0.08, 1.3% mol % I at 0.584; magenta dye forming coupler M-3 at 0.269; masking coupler MC-2 at 0.064; stabilizer STAB-2 at 0.054; gelatin at 1.72.

Layer 7 (Mid magenta layer): a green sensitized (as above) silver iodobromide emulsion: 1.3×0.12, 4.1 mol % iodide at 0.968; M-3 at 0.071; MC-2 at 0.064; D-3 at 0.024; stabilizer STAB-2 at 0.014; gelatin at 1.37.

Layer 8 (Fast magenta layer): a green sensitized (as above) tabular silver iodobromide (2.3×0.13, 4.1 mol % I) emulsion at 0.968; gelatin at 1.275; Coupler M-3 at 0.060; MC-2 at 0.054; D-4 at 0.0011; D-5 at 0.0011 and stabilizer STAB-2 at 0.012.

Layer 9 (Yellow filter layer): AD-1 at 0.108 and gelatin at 1.29.

Layer 10 (Slow yellow layer): a blend of three tabular silver iodobromide emulsions sensitized with sensitizing dye BSD-2: (i) 0.5×0.08, 1.3 mol% I at 0.295 (ii) 1.0×0.25, 6 mol % I at 0.50 and (iii) 0.81×0.087, 4.5 mol % I at 0.215; gelatin at 2.51; yellow dye forming couplers Y-1 at 0.725 and Y-2 at 0.289; D-6 at 0.064; C-1 at 0.027 and BARC-1 at 0.003.

Layer 11 (Fast yellow layer): a blend of two blue sensitized (as above) silver iodobromide emulsions: (i) a large tabular emulsion, 3.3×0.14, 4.1 mol % I at 0.227 and (ii) a 3-D emulsion, 1.1×0.4, 9 mol % I at 0.656; Y-1 at 0.725; Y-2 at 0.289; D-6 at 0.029; C-1 at 0.048; BARC-1 at 0.007 and gelatin at 2.57.

Layer 12 (UV filter layer): gelatin at 0.699; silver bromide Lippman emulsion at 0.215; UV-1 at 0.011 and UV-2 at 0.011.

Layer 13 (Protective overcoat): gelatin at 0.882.

Hardener (bis(vinylsulfonyl)methane hardener at 1.75% of total gelatin weight), antifoggants (including 4-hydroxy-6-methyl- 1,3,3a,7-tetraazaindene), surfactants, coating aids, emulsion addenda, sequestrants, lubricants, matte and tinting dyes were added to the appropriate layers as is common in the art.

Structures Example 5

STAB-1

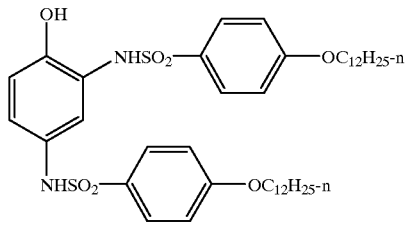

STAB-2

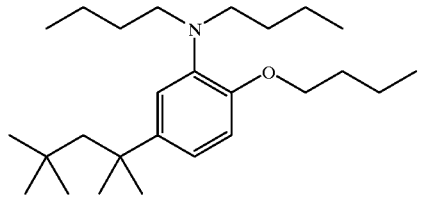

-continued
DYE-3
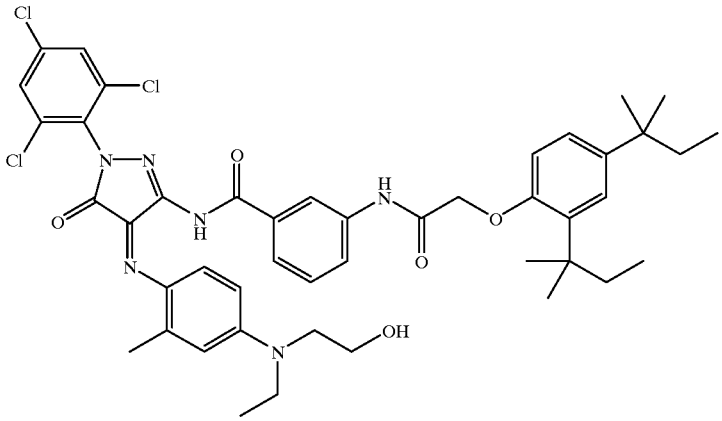
DYE-4
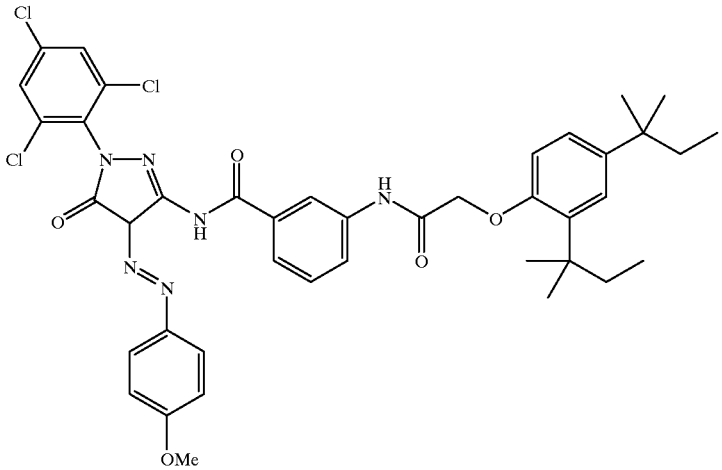
DYE-5
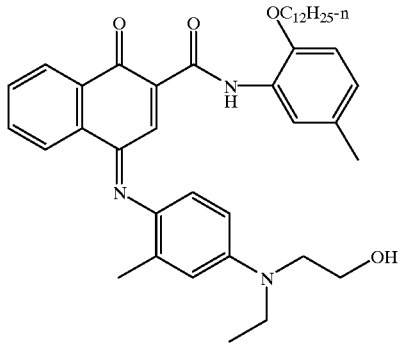

-continued
DYE-6
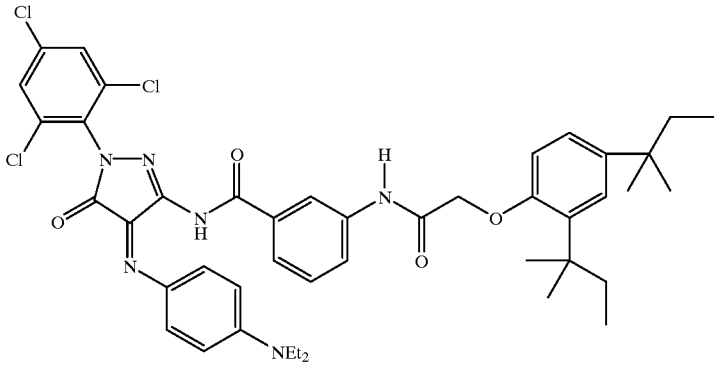
D-1
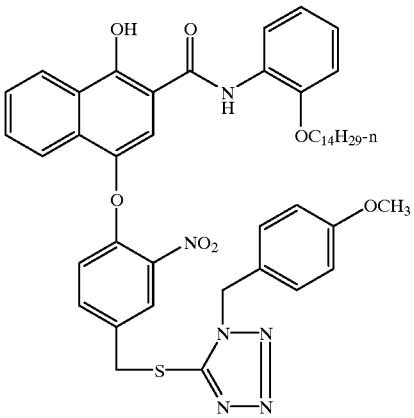
D-2
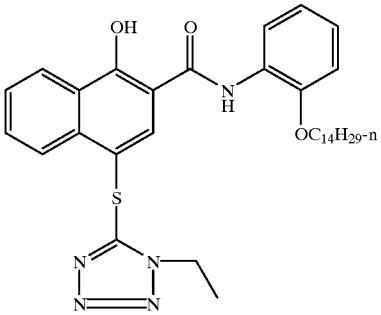
D-3
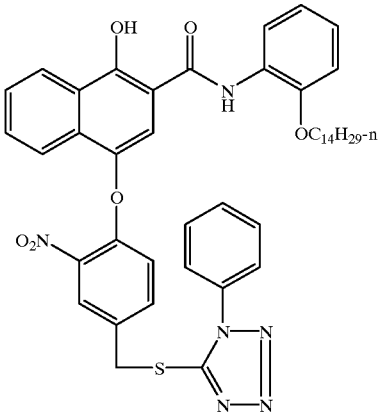

-continued
D-4
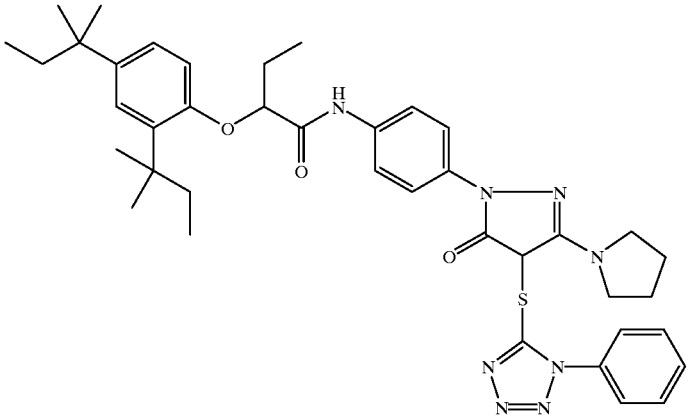
D-5
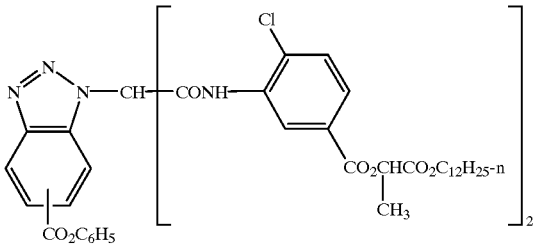
D-6
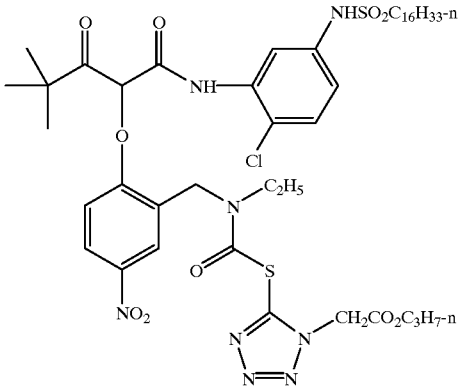
C-2
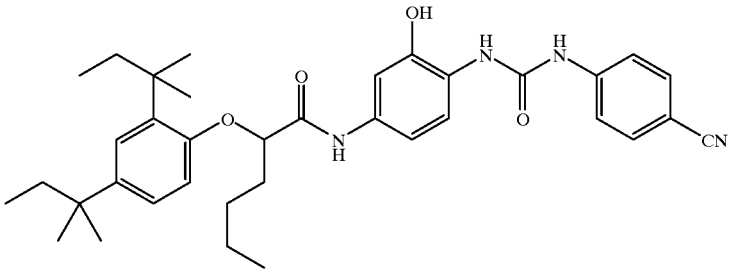

-continued
M-3
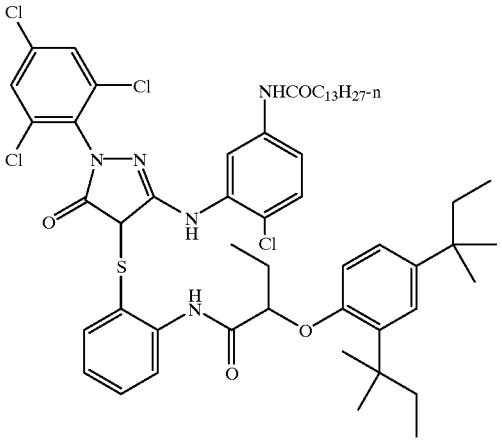
Y-1
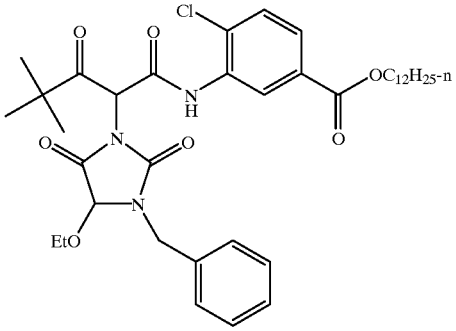
Y-2
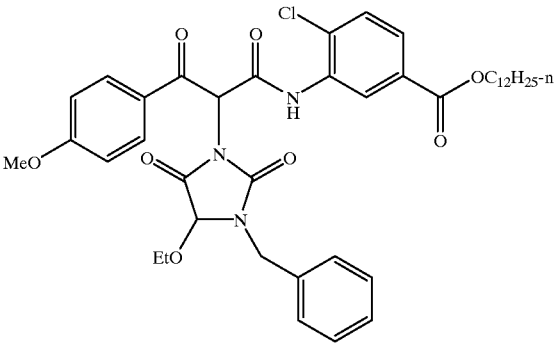
BARC-1
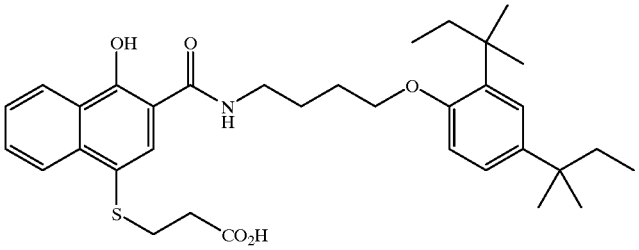

-continued
MC-1
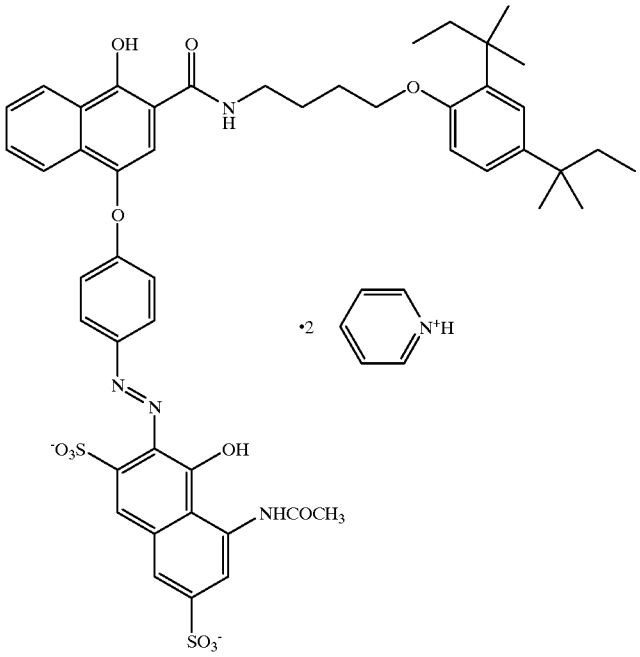
MC-2
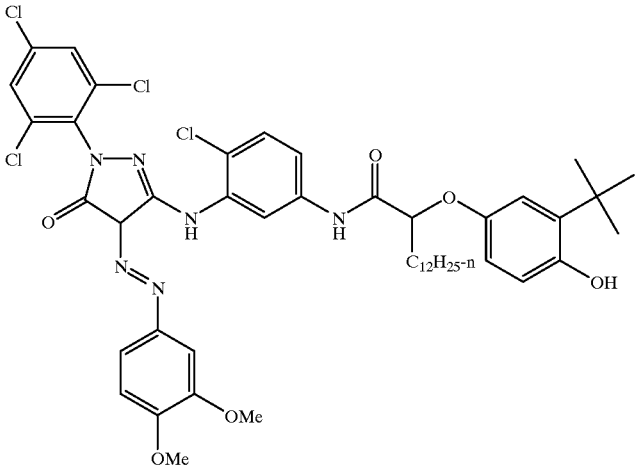
AD-1
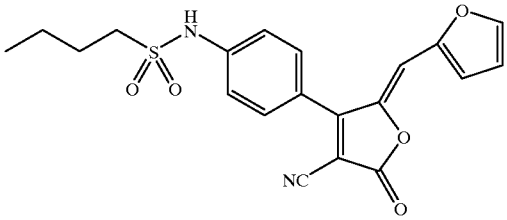
UV-3
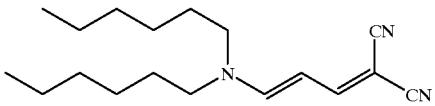
UV-4
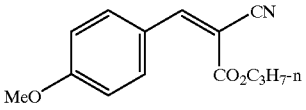

-continued
RSD-3
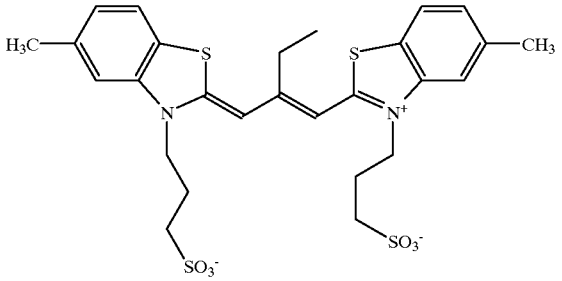
RSD-4
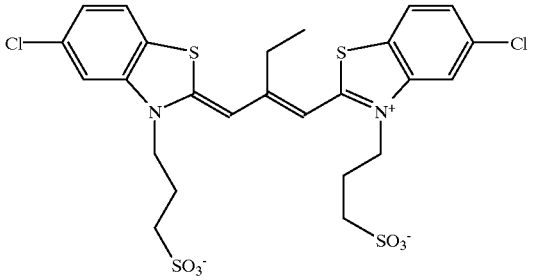
GSD-3
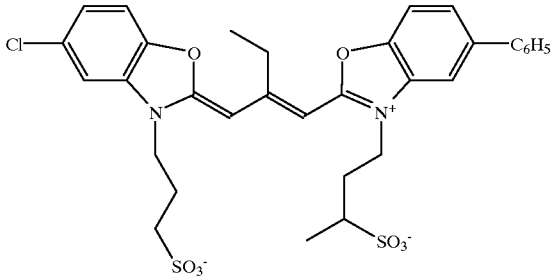
GSD-4
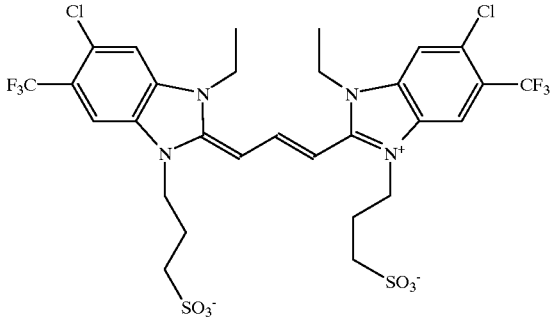
BSD-2
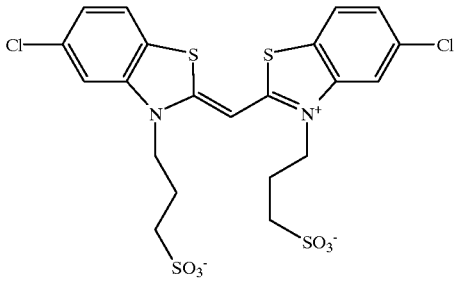

EXAMPLE 6

For example, in a prophetic example in a color negative element, the blocked PAMs may be coated with appropriately sensitized silver iodobromide emulsions on a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis(1,1-dimethylpropyl)phenoxy]-acetyl]amino]-5-[(2,2,3,3,4,4,4-heptafluoro-1-oxobutyl)amino]-4-hydroxyphenoxy]-2,3-dihydroxy-6-[(propylamino)carbonyl]phenyl]-thio]-1,3,4-thiadiazol-2-yl]thio]-, methyl ester and "Coupler 3": 1-((dodecyloxy)carbonyl) ethyl(3-chloro-4-((3-(2-chloro-4-((1-tridecanoylethoxy)carbonyl)anilino)-3-oxo-2-((4)(5)(6)-(phenoxycarbonyl)-1H-benzotriazol-1-yl)propanoyl)amino))-benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-, "Coupler 6": Carbamic acid, (6-(((3-(dodecyloxy)propyl)amino)carbonyl)-5-hydroxy-1-naphthalenyl)-, 2-methylpropyl ester, "Coupler 7": Acetic acid, ((2-((3-(((3-(dodecyloxy)propyl) amino) carbonyl)-4-hydroxy-8-(((2-methyl-propoxy) carbonyl)amino)-1-naphthalenyl)oxy)ethyl)thio)-, and "Coupler 8": Benzamide, 3-((2-(2,4-bis(1,1-dimethylpropyl)-phenoxy)-1-oxobutyl)amino)-N-(4,5-dihydro-4-((4-methoxyphenyl)-azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1 -(2,4,6-trichlorophenyl)-4,5-dihydro-5-oxo-1H-pyrazol-3-yl] -2-methyl-2-propenamide; and "Coupler 10": Tetradecanamide, N-(4-chloro-3-((4-((4-((2,2-dimethyl-1-oxopropyl)amino)phenyl)azo)-4,5-dihydro-5-oxo-1 -(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)-phenoxy)propyl)amino)-carbonyl)-4-hydroxy-1-naphthalenyl)oxy)ethoxy)phenyl)azo)-4-hydroxy-, disodium salt; and a slow cyan layer containing Couplers 2 and 6;

(7) an undercoat layer containing Coupler 8; and (8) an antihalation layer.

The invention has been described in detail with particular reference to certain preferred embodiments thereof, but it will be understood that variations and modifications can be effected within the spirit and scope of the invention.

We claim:

1. A photographic element comprising a support and at least one photographic emulsion layer, and a compound having the structure:

$$R^1—NH—C(R^2)(R^3)—(TIME)_n\text{-}PAM$$

wherein $R^1$ is an electron withdrawing moiety;

TIME is a timing or linking group;

n is 0, 1, 2 or 3;

PAM is a photographically active moiety wherein the photographically active moiety is a releasable development inhibitor, developing agent, development accelerator, bleach inhibitor, bleach accelerator, dye, dye precursor, stabilizer, nulceator, fixing agent, image toner, hardener, antifoggant, or ultraviolet radiation absorber; and $R^2$ and $R^3$ are independently hydrogen, substituted or unsubstituted alkyl, aryl, heteroaryl, alkenyl, or alkynyl groups, can be combined with $R^1$ to form a ring, or can combine together to form a ring, with the proviso $R^2$ and $R^3$ cannot together form a double bond with another atom and neither $R^2$ nor $R^3$ can be selected from RO—, RS—, $R_2N$—, or RSe— where R represents any substituent.

2. A photographic element according to claim 1 wherein $R^1$ is represented by $R^4C(=O)$—, $R^4S(=O)_2$—, $R^4S(=O)$—, or $R^4R^5P(=O)$—, wherein $R^4$ and $R^5$ are independently substituted or unsubstituted aLkyl, aryl, alkoxy, aryloxy, amino, arylthio, aLkylthio, or heterocyclic groups, or $R^4$ and $R^5$ may connect to form a ring which includes the phosphorous atom.

3. A photographic element according to claim 2 wherein n is 0, and $R^1$— is $R^4C(=O)$— or $R^4S(=O)_2$—.

4. A photographic element according to claim 1 wherein the photographically active moiety is a development inhibitor, a development accelerator, a bleach inhibitor, a bleach accelerator or a development agent precursor.

5. A photographic element according to claim 1 wherein the photographically active moiety is a development inhibitor.

6. A photographic element according to claim 5 wherein the photographic element is a color reversal or black and white photographic element.

7. A photographic element according to claim 5 wherein the photographic element is a color reversal photographic element.

8. A photographic element according to claim 7 wherein $R^1$ is represented by $R^4C(=O)$—, $R^4S(=O)_2$—, $R^4S(=O)$—, or $R^4R^5P(=O)$—, wherein $R^4$ and $R^5$ are independently substituted or unsubstituted alkyl, aryl, alkoxy, aryloxy, amino, arylthio, alkylthio, or heterocyclic groups, or $R^4$ and $R^5$ may connect to form a ring which includes the phosphorous atom.

9. A photographic element according to claim 8 wherein n is 0, and $R^1$— is $R^4C(=O)$— or $R^4S(=O)_2$—.

10. A photographic element according to claim 5 wherein $R^1$ is represented by $R^4C(=O)$—, $R^4S(=O)_2$—, $R^4S(=O)$—, or $R^4R^5P(=O)$—, wherein $R^4$ and $R^5$ are independently substituted or unsubstituted alkyl, aryl, alkoxy, aryloxy, amino, arylthio, alkylthio, or heterocyclic groups, or $R^4$ and $R^5$ may connect to form a ring which includes the phosphorous atom.

11. A photographic element according to claim 10 wherein n is 0, and $R^1$— is $R^4C(=O)$— or $R^4S(=O)_2$—.

12. A photographic element according to claim 1 wherein n is 0.

* * * * *